US011715414B2

(12) United States Patent
Kim et al.

(10) Patent No.: US 11,715,414 B2
(45) Date of Patent: Aug. 1, 2023

(54) DISPLAY DEVICE HAVING GATE INPUT VOLTAGE COMPENSATION

(71) Applicant: Samsung Display Co., LTD., Yongin-si (KR)

(72) Inventors: Soo Yeon Kim, Yongin-si (KR); Dae Gwang Jang, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/731,125

(22) Filed: Apr. 27, 2022

(65) Prior Publication Data

US 2022/0383801 A1 Dec. 1, 2022

(30) Foreign Application Priority Data

May 28, 2021 (KR) ..... 10-2021-0069373

(51) Int. Cl.
*G09G 3/32* (2016.01)

(52) U.S. Cl.
CPC ..... *G09G 3/32* (2013.01); *G09G 2330/021* (2013.01)

(58) Field of Classification Search
CPC ..... G09G 3/32
USPC ..... 345/55
See application file for complete search history.

(56) References Cited

U.S. PATENT DOCUMENTS

2002/0063703 A1* 5/2002 Furuhashi ..... G09G 3/3696 345/212
2018/0315369 A1* 11/2018 Pyun ..... G09G 3/2092
2020/0372851 A1 11/2020 Kim et al.

FOREIGN PATENT DOCUMENTS

KR 10-2020-0135633 A 12/2020

* cited by examiner

*Primary Examiner* — Long D Pham
(74) *Attorney, Agent, or Firm* — Lewis Roca Rothgerber Christie LLP

(57) ABSTRACT

A display device includes: a display panel including pixels, first to N-th gate integrated circuits (GICs) embedded in gate circuit boards and configured to output gate signals to the pixels, a first gate input power line and a first gate input signal line formed to pass through the gate circuit boards and connected to the GICs, a first feedback power line connected to the first gate input power line, a power supply configured to output a first gate input voltage to the first gate input power line, a first compensator configured to output a first compensation signal in response to a first feedback voltage from the first feedback power line, and a controller configured to output a first gate control signal to the first gate input signal line and output a power control signal to the power supply in response to the first compensation signal.

20 Claims, 14 Drawing Sheets

FBL: FBL1, FBL2
FBV: FBV1, FBV2
GCS: STV, CLK1, CLK2, OE
SC: SC1~SCk
SC': SC1'~SCk'
SSC: SSC1~SSCk
SSC': SSC1'~SSCk'
GVIN: VCC, VON, VOFF
VLI: VLI1~VLI3

DISPLAY DEVICE HAVING GATE INPUT VOLTAGE COMPENSATION

CROSS-REFERENCE TO RELATED APPLICATION

This application claims priority to and the benefit of Korean Patent Application No. 10-2021-0069373 filed on May 28, 2021, the entire content of which is incorporated herein by reference.

BACKGROUND

1. Technical Field

Aspects of some embodiments of the present disclosure relate to a display device.

2. Related Art

Recently, public interest in information displays has increased. Accordingly, research and development into display devices is continuously being conducted.

The above information disclosed in this Background section is only for enhancement of understanding of the background and therefore the information discussed in this Background section does not necessarily constitute prior art.

SUMMARY

Aspects of some embodiments of the present disclosure are directed to a display device capable of compensating for a voltage drop that may occur in gate input lines while reducing a non-display area of a display panel.

The characteristics of embodiments according to the present disclosure are not limited to the above-mentioned characteristics, and other technical characteristics will be clearly understood by those skilled in the art from the following description.

A display device according to some embodiments of the present disclosure may include a display panel including pixels in a display area, first to N-th gate integrated circuits embedded in gate circuit boards connected to the display panel and configured to output gate signals to the pixels, where N is a natural number equal to or greater than 2, a first gate input power line and a first gate input signal line formed to pass through the gate circuit boards and connected to the gate integrated circuits, a first feedback power line connected to the first gate input power line, a power supply configured to output a first gate input voltage to the first gate input power line, a first compensator connected to the first feedback power line and configured to output a first compensation signal in response to a first feedback voltage transferred from the first feedback power line, and a controller configured to output a first gate control signal to the first gate input signal line and to output a power control signal to the power supply in response to the first compensation signal. The power supply may adjust the first gate input voltage in response to the power control signal.

According to some embodiments, the first feedback power line may be connected to the first gate input power line in the vicinity of (or at) the N-th gate integrated circuit and formed to pass through the gate circuit boards.

According to some embodiments, the N-th gate integrated circuit may be farthest from the power supply, among the first to N-th gate integrated circuits.

According to some embodiments, the gate circuit boards may include first to N-th gate circuit boards in which the first to N-th gate integrated circuits are respectively embedded. The first gate integrated circuit may be connected to the power supply via the first gate circuit board, and the N-th gate integrated circuit may be connected to the power supply via the first to N-th gate circuit boards.

According to some embodiments, the power supply may output a first reference voltage to the first compensator. The first compensator may output the first compensation signal at a logic high level to the controller in case that a voltage difference between the first feedback voltage and the first reference voltage is equal to or greater than a first set value.

According to some embodiments, the controller may output the power control signal for changing the first gate input voltage in response to the first compensation signal at the logic high level.

According to some embodiments, the power supply may output the first gate input voltage to the controller. The controller may generate the first gate control signal using the first gate input voltage.

According to some embodiments, the first gate input voltage may be an operating voltage of the first to N-th gate integrated circuits.

According to some embodiments, the display device may further include a second gate input power line through which a second gate input voltage is supplied from the power supply, the second gate input power line being formed to pass through the gate circuit boards and connected to the first to N-th gate integrated circuits, and a second feedback power line connected to the second gate input power line, the second feedback power line being formed to pass through the gate circuit boards and connected to the first compensator.

According to some embodiments, the first compensator may include a first comparator configured to output the first compensation signal depending on a voltage difference between the first feedback voltage and a first reference voltage, and a second comparator configured to output a second compensation signal depending on a voltage difference between a second feedback voltage transferred from the second feedback power line and a second reference voltage.

According to some embodiments, the controller may control the first gate input voltage generated in the power supply in response to the first compensation signal, and may control the second gate input voltage generated in the power supply in response to the second compensation signal.

According to some embodiments, the second gate input voltage may be one of a gate-off voltage and a gate-on voltage.

According to some embodiments, the display device may further include a second gate input signal line formed in the display panel so as to be adjacent to the gate circuit boards and connected to the first to N-th gate integrated circuits.

According to some embodiments, the controller may output a second gate control signal synchronized with the first gate control signal to the second gate input signal line.

According to some embodiments, at least one of the first to N-th gate integrated circuits may include a second compensator configured to supply a current to the first gate input signal line in case that a voltage difference between the first gate control signal and the second gate control signal, respectively transferred through the first gate input signal line and the second gate input signal line, is equal to or greater than a second set value.

According to some embodiments, the second compensator may include a current source configured to supply the current, a third comparator configured to output a switching signal depending on a voltage difference between the first gate control signal and the second gate control signal, and a switch connected between the current source and the first gate input signal line and configured to be selectively turned on in response to the switching signal.

According to some embodiments, the first gate control signal may be a first clock signal output from the controller. The second gate control signal may be a second clock signal output from the controller so as to be synchronized with the first clock signal.

According to some embodiments, the display device may further include a dummy line connected to the second gate input signal line and formed to pass through the gate circuit boards.

According to some embodiments, at least one of the first to N-th gate integrated circuits may include a second compensator configured to supply a current to the first gate input signal line in case that a voltage difference between a second gate control signal transferred through the second gate input signal line and a second gate control signal transferred through the dummy line is equal to or greater than a third set value.

According to some embodiments, the second gate control signal may be a gate start pulse output from the controller.

Other details and characteristics of some embodiments are included in the detailed description and the drawings.

BRIEF DESCRIPTION OF THE DRAWINGS

FIG. 12 is a waveform diagram illustrating a first clock signal generated in a power supply, a first clock signal delayed in a first gate input signal line, and a first clock signal, the delay of which is compensated for.

DETAILED DESCRIPTION

Figure 1:
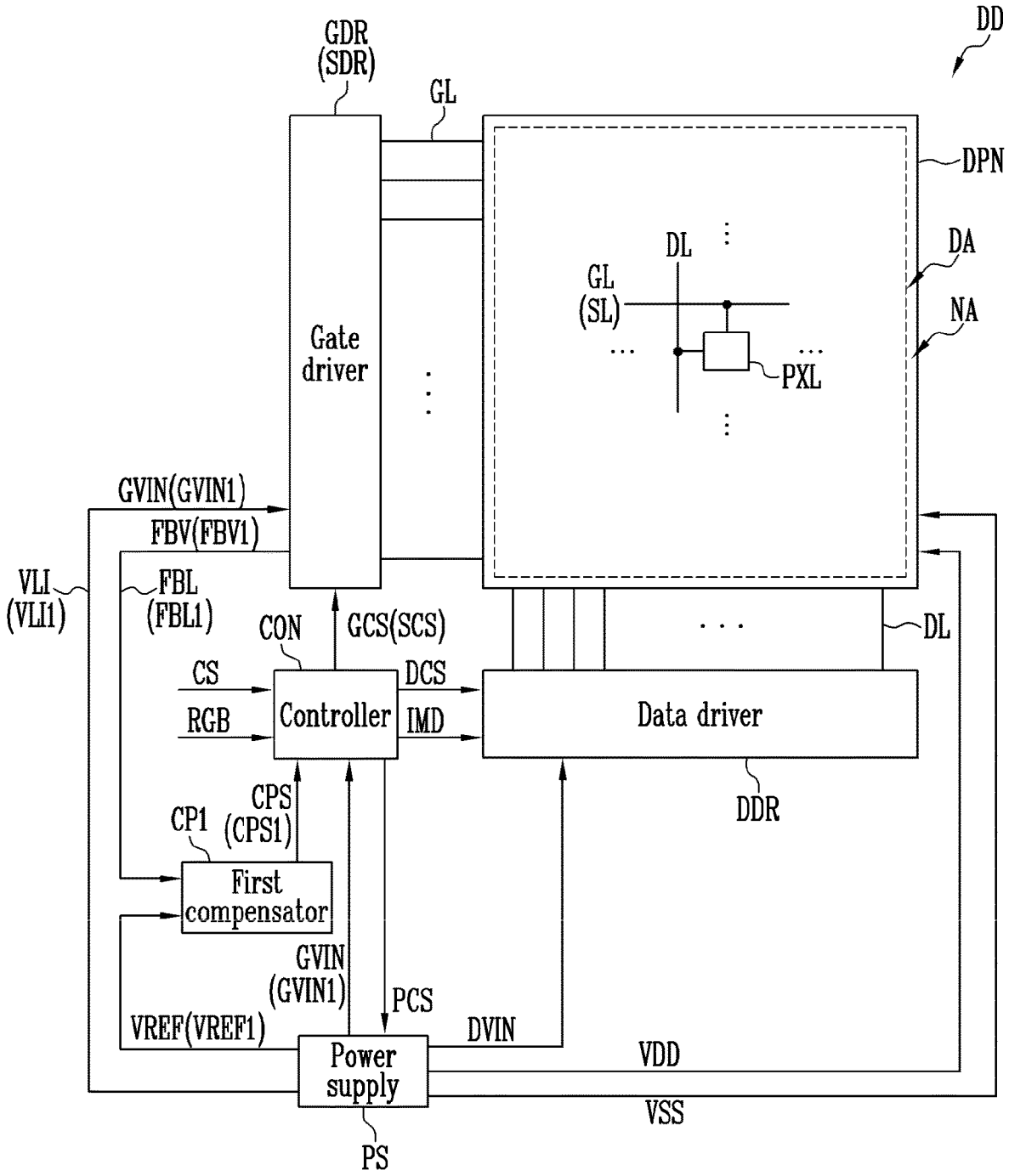
FIG. 1 is a block diagram illustrating a display device according to some embodiments of the present disclosure.

Because embodiments according to the present disclosure may have various changes and various forms, particular embodiments will be illustrated in the drawings and described in detail in the written description. In the following description, the singular forms are intended to include the plural forms as well, unless the context clearly indicates otherwise.

Meanwhile, the present disclosure is not limited to the embodiments set forth herein, and may be embodied in different forms. Also, each of the embodiments set forth herein may be used individually or by being combined with at least one of the other embodiments.

In order to more clearly explain aspects of some embodiments of the present disclosure, certain parts not directly relevant to the description may be omitted. In all of the drawings, the same or similar components are assigned the same reference numerals and symbols as possible although they are illustrated in different drawings, and a repeated description will be omitted.

When aspects of embodiments of the present disclosure are described, "connection (or coupling)" may encompass through physical and/or electrical connection (or coupling). Also, this may encompass through direct or indirection connection (or coupling) and integral or non-integral connection.

FIG. 1 is a block diagram illustrating a display device DD according to some embodiments of the present disclosure.

Referring to FIG. 1, the display device DD may include a display panel DPN including pixels a plurality of pixels PXL and a driving circuit for driving the pixels PXL. Although FIG. 1 illustrates a single pixel PXL, a person having ordinary skill in the art would understand that the display device DD may include any suitable number of pixels according to the design and configuration of the display panel DPN. The driving circuit may include a gate driver GDR, a data driver DDR, a controller CON, a power supply PS (also referred to as "power voltage generator"), and a first compensator CP1.

The display panel DPN may include a display area DA. The display area DA may include a plurality of gate lines GL, data lines DL, and the pixels PXL connected to the gate lines GL and the data lines DL.

The gate lines GL may connect the gate driver GDR to the pixels PXL. Accordingly, gate signals output from the gate driver GDR may be delivered to the pixels PXL through the gate lines GL.

The gate lines GL include scan lines SL, and may optionally further include at least one control line. The gate signals include scan signals supplied to the scan lines SL, and may optionally further include a control signal supplied to at least one control line. The driving timing of the pixels PXL (e.g., a data programming period during which data signals are input to the pixels PXL) may be controlled by the scan signals.

The data lines DL may connect the data driver DDR to the pixels PXL. Accordingly, data signals output from the data driver DDR may be delivered to the pixels PXL through the data lines DL. Using the data signals, emission of the pixels PXL may be controlled.

The pixels PXL may be located in the display area DA. According to some embodiments, the pixels PXL in a matrix form or arrangement (e.g., columns and rows of pixels PXL) may be arranged in the display area DA, and the display area DA may include horizontal lines and vertical lines intersecting with the horizontal lines.

Each of the horizontal lines may include a plurality of pixels PXL arranged along a horizontal direction (or a lateral direction) and at least one gate line GL connected to the plurality of pixels PXL. For example, each of the horizontal lines may include a plurality of pixels PXL arranged along a horizontal direction and a scan line SL connected in common to the pixels PXL.

Each of the vertical lines may include a plurality of pixels PXL arranged along a vertical direction (or a longitudinal direction) and at least one data line DL connected to the pixels PXL. According to some embodiments, each of the vertical lines may include pixel groups of different colors or types, and may include a plurality of data lines DL connected to the respective pixel groups. For example, each of the vertical lines includes red pixels, green pixels, and blue pixels, and may include a first data line connected in common to the red pixels, a second data line connected in common to the green pixels, and a third data line connected in common to the blue pixels.

Each of the pixels PXL may be connected to at least one gate line GL (e.g., a scan line SL of each horizontal line) and a data line DL. Also, each of the pixels PXL may be further connected to at least one signal line and/or at least one power line. For example, each of the pixels PXL may be further connected to a first power line, a second power line, an initialization power line, and/or a control line.

The pixels PXL may be supplied with data signals through the data lines DL when scan signals are supplied from the scan lines SL. Each of the pixels PXL may emit light in response to the data signal supplied to the pixel PXL in the emission period of each frame.

According to some embodiments, the pixels PXL may be supplied with at least one type of pixel power. For example, the pixels PXL may be supplied with first pixel power VDD and second pixel power VSS from the power supply PS. The first pixel power VDD may be high-potential pixel power, and the second pixel power VSS may be low-potential pixel power.

The arrangement structure and direction of the pixels PXL, arranged in the display area DA, may be variously changed according to some embodiments. Also, the types and number of signal lines and/or power lines connected to the pixels PXL may be variously changed according to some embodiments.

The display panel DPN may further include a non-display area NA located around the display area DA. For example, the non-display area NA may be located along the edge of the display panel DPN so as to enclose the display area DA.

The non-display area NA may include lines, connected to the pixels PXL of the display area DA, and pads. For example, the non-display area NA may include gate pads for connecting the gate driver GDR to the gate lines GL and data pads for connecting the data driver DDR to the data lines DL.

The gate driver GDR may be supplied with a gate control signal GCS from the controller CON, and may be supplied with a gate input voltage GVIN from the power supply PS. The gate driver GDR may generate gate signals using the gate control signal GCS and the gate input voltage GVIN, and may output the gate signals to the gate lines GL.

The gate driver GDR includes a scan driver SDR, and may optionally further include at least one control line driver. The gate control signal GCS includes a scan control signal SCS, and may optionally further include at least one control signal other than that. The scan driver SDR may supply scan signals to the scan lines SL in response to the scan control signal SCS.

According to some embodiments, the gate control signal GCS may include a gate start pulse (e.g., a sampling pulse input to a first stage provided in the shift register of the gate driver GDR), at least one gate clock signal (e.g., at least one clock signal input to stages provided in the shift register of the gate driver GDR), and a gate output enable signal (e.g., an output enable signal configured to control the output timing of the gate signals). The types and number of gate control signals GCS may be variously changed according to some embodiments.

The gate input voltage GVIN includes at least a first gate input voltage GVIN1, and may further include at least one input voltage other than that. According to some embodiments, the first gate input voltage GVIN1 may be the operating voltage (or logic voltage) of the gate driver GDR. For example, the first gate input voltage GVIN1 may be the operating voltage of the shift register. According to some embodiments, the gate input voltage GVIN may further include a gate-on voltage (e.g., a voltage corresponding to a logic-high gate signal) and a gate-off voltage (e.g., a voltage corresponding to a logic-low gate signal). The types and number of gate input voltages GVIN may be variously changed according to some embodiments.

The respective gate input voltages GVIN may be supplied from the power supply PS to the gate driver GDR through the respective gate input power lines VLI. For example, the first gate input voltage GVIN1 may be supplied from the power supply PS to the gate driver GDR through the first gate input power line VLI1.

At least one gate input voltage GVIN is also supplied to the controller CON, thereby being used to generate a gate control signal GCS. For example, the first gate input voltage GVIN1 is supplied to the controller CON, and the controller CON may generate at least one gate control signal GCS using the first gate input voltage GVIN1.

The data driver DDR may be supplied with a data control signal DCS and image data IMD from the controller CON, and may be supplied with a data input voltage DVIN from the power supply PS. The data driver DDR may output data signals of each frame to the data lines DL in response to the data control signal DCS, the image data IMD, and the data input voltage DVIN.

According to some embodiments, the data control signal DCS may include a source sampling pulse, a source sampling clock, a source output enable signal, and the like. According to some embodiments, each of the data signals may be a data voltage corresponding to the grayscale data of the corresponding pixel PXL, among the image data IMD of the corresponding frame.

The controller CON may be supplied with driving control signals CS and an input image signal RGB from the outside (e.g., a host processor), and may control the gate driver GDR and the data driver DDR in response to the driving control signals CS and the input image signal RGB. The driving control signals CS may include various kinds of timing signals, such as a vertical synchronization signal, a horizontal synchronization signal, a main clock signal, and the like.

The controller CON may generate a gate control signal GCS and a data control signal DCS in response to the driving control signals CS. The gate control signal GCS may be supplied to the gate driver GDR, and the data control signal DCS may be supplied to the data driver DDR.

According to some embodiments, the controller CON may be supplied with at least one gate input voltage GVIN from the power supply PS, and may generate a gate control signal GCS using the gate input voltage GVIN. For example, the controller CON may be supplied with the first gate input voltage GVIN1 (e.g., the operating voltage of the gate driver GDR) from the power supply PS, and may generate at least one gate clock signal and/or gate output enable signal for controlling the driving timing of the gate driver GDR using the first gate input voltage GVIN1.

The controller CON may generate image data IMD of each frame using the input image signal RGB, and may supply the image data IMD to the data driver DDR. For example, the controller CON converts the data format of the input image signal RGB in compliance with the specifications of the interface with the data driver DDR, thereby generating image data IMD.

According to some embodiments of the present disclosure, the controller CON may be supplied with a compensation signal CPS from the first compensator CP1, and may control the power supply PS in response to the compensation signal CPS. For example, the controller CON may output a power control signal PCS, based on which control is performed to change at least one gate input voltage GVIN (e.g., the operating voltage the gate driver GDR and/or gate-off voltage) generated in the power supply PS in response to the compensation signal CPS, to the power supply PS.

The power supply PS may generate various kinds of driving power for driving the pixels PXL, the gate driver GDR, the data driver DDR, the controller CON, and the first compensator CP1. For example, the power supply PS may generate first pixel power VDD and second pixel power VSS for driving the pixels PXL, at least one gate input voltage GVIN for driving the gate driver GDR and the controller CON, at least one data input voltage DVIN for driving the data driver DDR, and at least one reference voltage VREF for driving the first compensator CP1. The power supply PS may be or may include a PMIC (power management integrated circuit).

According to some embodiments of the present disclosure, the power supply PS may generate a gate input voltage GVIN in response to the power control signal PCS input from the controller CON. For example, the power supply PS may change at least one gate input voltage GVIN in response to the power control signal PCS, and may output the same.

The first compensator CP1 may be supplied with at least one feedback voltage FBV from at least one feedback power line FBL, and may be supplied with at least one reference voltage VREF from the power supply PS. The first compensator CP1 may output a compensation signal CPS in response to the feedback voltage FBV and the reference voltage VREF.

According to some embodiments of the present disclosure, each feedback power line FBL may be connected to any one gate input power line VLI configured to transfer any one gate input voltage GVIN. The gate input voltage GVIN may be output from the power supply PS and input to the first compensator CP1 via the gate input power line VLI and the feedback power line FBL. Accordingly, the gate input voltage GVIN, which may drop by passing through the gate input power line VLI and the feedback power line FBL (e.g., IR-dropped gate input voltage GVIN), may be input to the first compensator CP1 as the feedback voltage FBV.

For example, the feedback power line FBL may include a first feedback power line FBL1 for feeding back the first gate input voltage GVIN1. The first feedback power line FBL1 may be connected between the first gate input power line VLI1 and the first compensator CP1. The first gate input voltage GVIN1 output from the power supply PS may be input to the first compensator CP1 via the first gate input power line VLI1 and the first feedback power line FBL1. While it passes through the first gate input power line VLI1 and the first feedback power line FBL1, the first gate input voltage GVIN1 may drop, and the first compensator CP1 may be supplied with the dropped first gate input voltage GVIN1 as the first feedback voltage FBV1.

The first compensator CP1 may compare the feedback voltage FBV, supplied from each feedback power line FBL, with a reference voltage VREF corresponding thereto and output a compensation signal CPS in response to the voltage difference between the feedback voltage FBV and the reference voltage VREF. In case that the voltage difference between the feedback voltage FBV and the reference voltage VREF is equal to or greater than a set value, the first compensator CP1 may output a compensation signal CPS based on which control is performed to change each gate input voltage GVIN in response to the feedback voltage FBV.

For example, the first compensator CP1 may be supplied with a first feedback voltage FBV1 from the first feedback power line FBL1 by being connected thereto, and may compare the first feedback voltage FBV1 with a first reference voltage VREF1 supplied from the power supply PS. In case that the voltage difference between the first feedback voltage FBV1 and the first reference voltage VREF1 is equal to or greater than a first set value, the first compensator CP1 may output a first compensation signal CP1 based on which control is performed to change the first gate input voltage GVIN1.

The display device DD according to the above-described embodiments may detect a feedback voltage FBV for at least one gate input voltage GVIN through a feedback power line FBL connected to at least one gate input power line VLI, and may compensate for the voltage drop of the at least one gate input voltage GVIN by comparing the feedback voltage FBV with a reference voltage VREF corresponding thereto. Also, in case that at least one gate control signal GCS is generated by the gate input voltage GVIN, the voltage of the at least one gate control signal GCS may also be changed, whereby the voltage drop of the at least one gate control signal GCS may also be compensated for.

Figure 2:
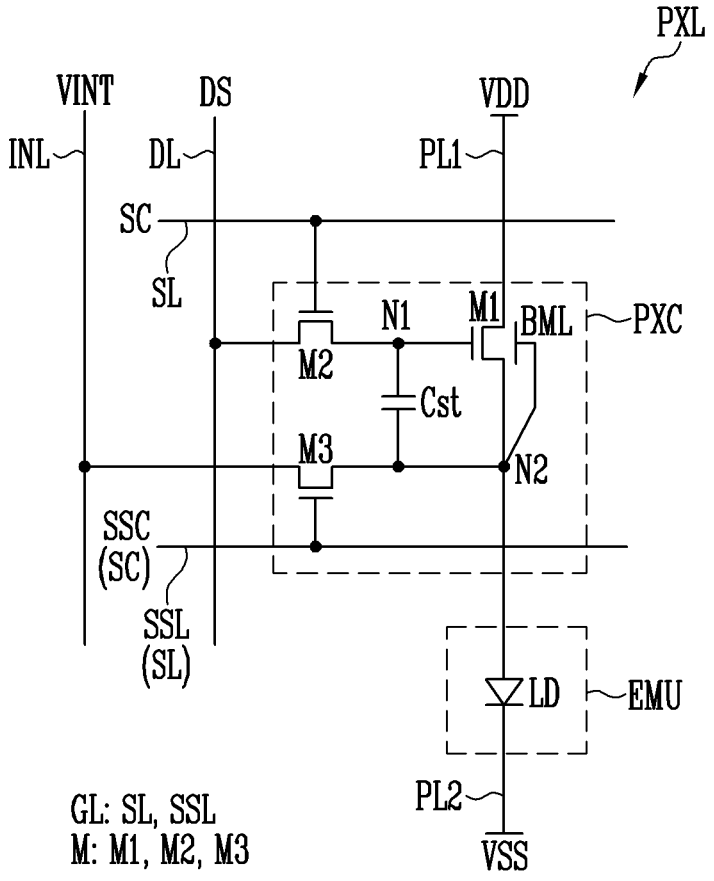
FIGS. 2 and 3 are circuit diagrams illustrating a pixel according to some embodiments of the present disclosure.
Figure 3:
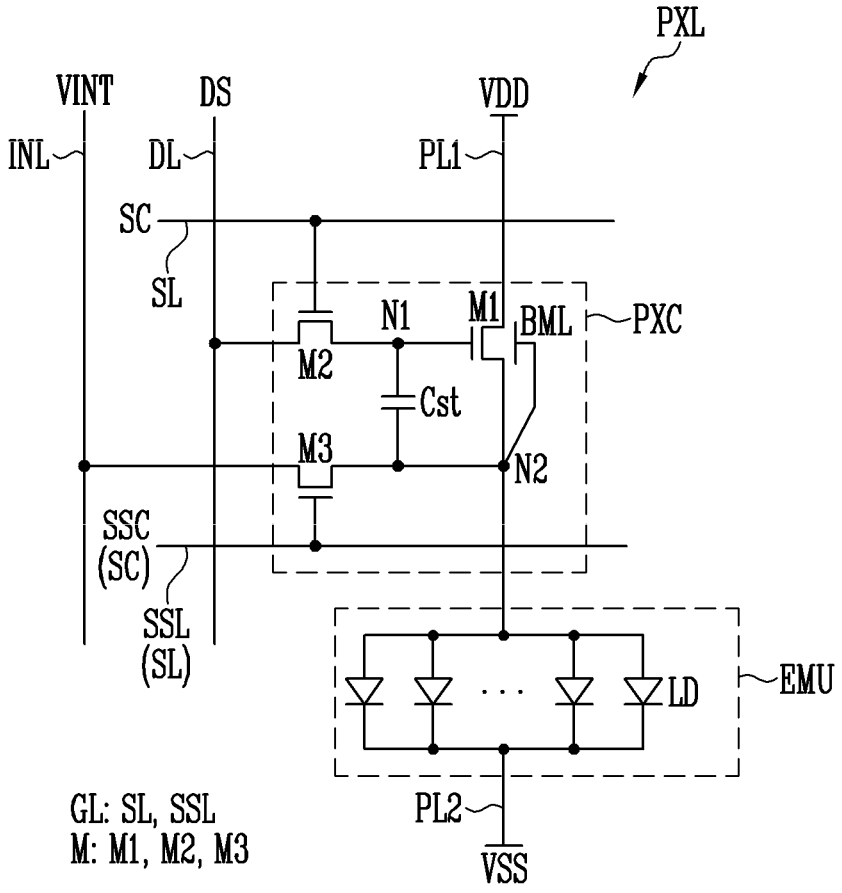

FIGS. 2 and 3 are circuit diagrams illustrating a pixel PXL according to some embodiments of the present disclosure. For example, FIGS. 2 and 3 illustrate any one pixel PXL that can be located in the display area DA of FIG. 1, and illustrate different embodiments with regard to the emitter EMU of the pixel PXL. According to some embodiments, the pixels PXL located in the display area DA may have structures that are substantially the same as or similar to each other. Additionally, according to some embodiments, the pixels PXL may include additional components or fewer components without departing from the spirit and scope of embodiments according to the present invention.

Referring to FIGS. 2 and 3, the pixel PXL may be connected to a scan line SL, a data line DL, a first power line PL1, and a second power line PL2. Also, the pixel PXL may optionally be further connected to at least one power line other than that and/or a signal line. For example, the pixel PXL may be further connected to an initialization power line INL (or a sensing line) and/or a control line SSL.

The pixel PXL may include an emitter EMU for generating light of luminance corresponding to each data signal DS. Also, the pixel PXL may further include a pixel circuit PXC for driving the emitter EMU.

The pixel circuit PXC may be connected to the scan line SL and the data line DL, and may be connected between the first power line PL1 and the emitter EMU. For example, the pixel circuit PXC may be connected to the scan line SC through which a scan signal SC is supplied, the data line DL through which a data signal DS is supplied, the first power line PL1 through which first pixel power VDD is supplied, and the emitter EMU.

Also, the pixel circuit PXC may optionally be further connected to the control line SSL, through which a control signal SSC is supplied, and the initialization power line INL, which is connected to the source of initialization power VINT or a sensing circuit in response to a display period or a sensing period. In this case, gate lines GL may include the scan lines SL and the control lines SSL located in respective horizontal lines.

According to some embodiments, the control signal SSC may be a signal that is the same as or different from the scan signal SC. In case that the control signal SSC is the same signal as the scan signal SC, the control line SSL may be selectively integrated with the scan line SL.

The pixel circuit PXC may include at least one transistor M and a capacitor Cst. For example, the pixel circuit PXC may include a first transistor M1, a second transistor M2, a third transistor M3, and a capacitor Cst.

The first transistor M1 may be connected between the first power line PL1 and a second node N2. The second node N2 may be a node to which the emitter EMU and the pixel circuit PXC are connected. For example, the second node N2 may be a node to which the first electrode (e.g., the source electrode) of the first transistor M1 and the first electrode of the emitter EMU (e.g., the anode electrode of the emitter EMU) are connected. The gate electrode of the first transistor M1 may be connected to a first node N1. The first transistor M1 may control a driving current supplied to the emitter EMU in response to the voltage of the first node N1. For example, the first transistor M1 may be the driving transistor of the pixel PXL.

According to some embodiments, the first transistor M1 may further include a bottom metal layer BML (referred to as a "second gate electrode" or a "back gate electrode"). According to some embodiments, the bottom metal layer BML may be connected to the first electrode (e.g., the source electrode) of the first transistor M1.

In embodiments in which the first transistor M1 includes a bottom metal layer BML, a back-biasing technique (or a sync technique) for moving the threshold voltage of the first transistor M1 in a negative direction or a positive direction by applying a back-biasing voltage to the bottom metal layer BML of the first transistor M1 may be applied or utilized. Also, in case that the bottom metal layer BML is arranged so as to overlap a semiconductor pattern forming the channel of the first transistor M1, light incident to the semiconductor pattern may be blocked, thereby enabling the operation characteristics of the first transistor M1 to be relatively stabilized.

The second transistor M2 may be connected between the data line DL and the first node N1. Also, the gate electrode of the second transistor M2 may be connected to the scan line SL. The second transistor M2 is turned on in response to a scan signal SC of a gate-on voltage (e.g., a logic-high voltage) being supplied from the scan line SL, thereby connecting the data line DL to the first node N1.

For each frame period, the data signal DS of the corresponding frame is supplied to the data line DL, and the data signal DS may be delivered to the first node N1 through the second transistor M2 for a period during which the scan signal SC of a gate-on voltage is supplied. For example, the second transistor M2 may be a switching transistor for delivering each data signal DS to the inside of the pixel PXL.

The first electrode of the capacitor Cst may be connected to the first node N1, and the second electrode thereof may be connected to the second node N2. The capacitor Cst is charged with a voltage corresponding to the data signal DS supplied to the first node N1 for each frame period.

The third transistor M3 may be connected between the second node N2 and the initialization power line INL. Also, the gate electrode of the third transistor M3 may be connected to the control line SSL (or the scan line SL). The third transistor M3 is turned on in case that a control signal SSC (or a scan signal SC) of a gate-on voltage is supplied from the control line SSL, thereby transferring the voltage of initialization power VINT (or a reference voltage), supplied to the initialization power line INL, to the second node N2 or transferring the voltage of the second node N2 to the initialization power line INL. The voltage of the second node N2 transferred to the initialization power line INL is provided to the driving circuit (e.g., the controller CON) via the sensing circuit, thereby being used to compensate for the characteristic deviation of the pixels PXL.

Meanwhile, all of the transistors M included in the pixel circuit PXC are illustrated as N-type transistors in FIGS. 2 and 3, but the present disclosure is not limited thereto. For example, at least one of the first, second, or third transistors M1, M2 and M3 may be changed to a P-type transistor. Also, the structure and the driving method of the pixel PXL may be variously changed according to some embodiments.

The emitter EMU may include at least one light emitting element LD connected between the source of first pixel power VDD and the source of second pixel power VSS. The source of the first pixel power VDD and the source of the second pixel power VSS may supply voltages of different potentials. The potential difference between the first pixel power VDD and the second pixel power VSS may be equal to or greater than the threshold voltage of the light emitting element LD.

According to some embodiments, the emitter EMU may include a single light emitting element LD that is connected in a forward direction between the pixel circuit PXC and the source of the second pixel power VSS, as illustrated in FIG. 2. The anode electrode of the light emitting element LD may be connected to the source of the first pixel power VDD through the pixel circuit PXC and/or the first power line PL1, and the cathode electrode thereof may be connected to the source of the second pixel power VSS through the second power line PL2.

Alternatively, the emitter EMU may include a plurality of light emitting elements LD connected in a forward direction between the source of the first pixel power VDD and the source of the second pixel power VSS. For example, the emitter EMU may include a plurality of light emitting elements LD connected in parallel to each other between the pixel circuit PXC and the source of the second pixel power VSS, as illustrated in FIG. 3, or a plurality of light emitting elements LD connected in series or series-parallel to each other between the pixel circuit PXC and the source of the second pixel power VSS.

Each of the light emitting elements LD may be an organic light emitting element or an inorganic light emitting element. For example, each of the light emitting elements LD may be an organic light emitting diode or an inorganic light emitting diode. According to some embodiments, the emitter EMU may include a plurality of inorganic light emitting diodes, each of which is manufactured to have a small size ranging from nanometers to micrometers using a nitride-based semiconductor, (e.g., inorganic light emitting diodes manufactured in a bar shape or a core-shell shape and each of which has a size ranging from nanometers to micrometers), and the inorganic light emitting diodes may be connected in series, parallel, or series-parallel to each other. Also, the type(s), the structure(s) and/or the number of light emitting element(s) forming the emitter EMU may be variously changed according to some embodiments.

At least one light emitting element LD connected in a forward direction between the source of the first pixel power VDD and the source of the second pixel power VSS may form an effective light source of each pixel PXL. In case that a driving current is supplied to at least one light emitting element LD through the pixel circuit PXC, the at least one light emitting element LD may emit light with luminance corresponding to the driving current. Accordingly, the emitter EMU may emit light with luminance corresponding to the driving current.

Figure 4A:
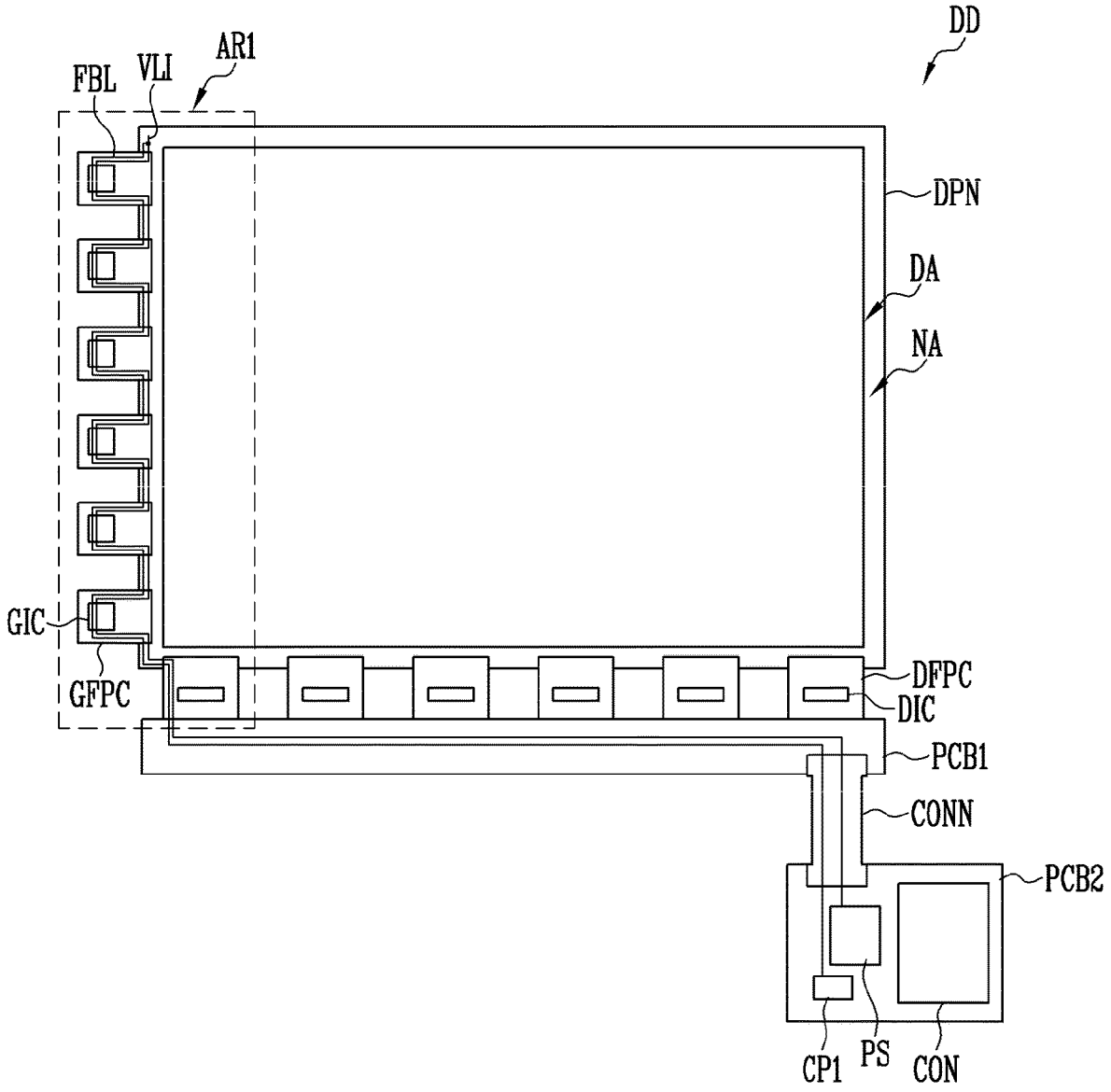
FIGS. 4A and 4B are plan views illustrating a display device according to some embodiments of the present disclosure.
Figure 4B:
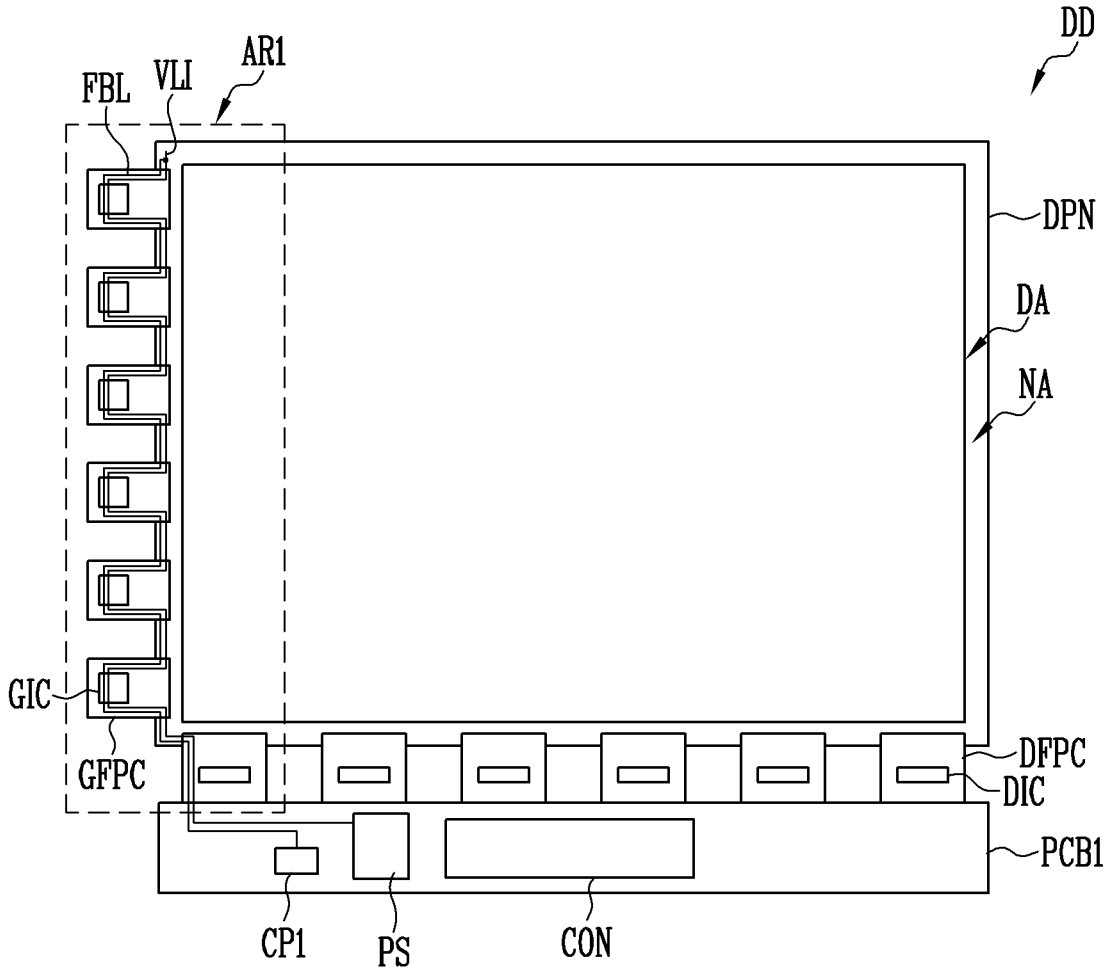

FIGS. 4A and 4B are plan views illustrating a display device DD according to some embodiments of the present disclosure. For example, FIGS. 4A and 4B disclose different embodiments with regard to the positions of a controller CON, a power supply PS, and a first compensator CP1.

Referring to FIGS. 1 to 4B, the display device DD may include a display panel DPN, gate integrated circuits GIC connected to the display panel DPN, data integrated circuits DIC, a controller CON, a power supply PS, and a first compensator CP1.

The gate integrated circuits GIC may form the gate driver GDR of FIG. 1. For example, the gate driver GDR may include a plurality of gate integrated circuits GIC (referred to as "gate driver IC(s)" or "gate IC(s)") for supplying respective gate signals (e.g., scan signals SC) to different gate lines GL.

According to some embodiments, the gate integrated circuits GIC may be embedded in respective gate circuit boards GFPC. The gate circuit boards GFPC may be connected to the gate pads of the display panel DPN through a bonding process or the like, and may be connected to the gate lines GL through the gate pads. Accordingly, the gate integrated circuits GIC may be connected to the respective gate lines GL. According to some embodiments, each of the gate circuit boards GFPC may be a flexible circuit board formed of a film material, and each of the gate integrated circuits GIC in the form of a chip on film (COF) may be provided to the display device DD.

The respective gate integrated circuits GIC may output gate signals to the pixels PXL connected to the gate lines GL corresponding thereto through the gate lines GL. For example, the gate integrated circuits GIC may sequentially output gate signals to the pixels PXL in units of horizontal lines along the direction intersecting with the gate lines GL.

Each of the gate integrated circuits GIC may be connected to the controller CON and/or the power supply PS through at least one gate circuit board GFPC, at least one data circuit board DFPC, a first circuit board PCB1, a cable CONN and/or a second circuit board PCB2.

The data integrated circuits DIC may form the data driver DDR of FIG. 1. For example, the data driver DDR may include a plurality of data integrated circuits DIC (referred to as "data driver IC(s)" or "data IC(s)") for supplying respective data signals to different data lines DL.

According to some embodiments, the data integrated circuits DIC may be embedded in the respective data circuit boards DFPC. The data circuit boards DFPC may be connected to the data pads of the display panel DPN through a bonding process or the like, and may be connected to the data lines DL through the data pads. Accordingly, the data integrated circuits DIC may be connected to the respective data lines DL. According to some embodiments, each of the data circuit boards DFPC may be a flexible circuit board of a film material, and each of the data integrated circuits GIC in the form of a COF may be provided to the display device DD.

The respective data integrated circuits DIC may output data signals DS to the pixels PXL connected to the data lines DL corresponding thereto through the data lines DL. For example, for each horizontal period, the data integrated circuits DIC may output data signals DS corresponding to the pixels PXL arranged in a horizontal line corresponding to the horizontal period.

Each of the data integrated circuits DIC may be connected to the controller CON and/or the power supply PS through each of the data circuit boards DFPC, the first circuit board PCB1, the cable CONN, and/or the second circuit board PCB2.

According to some embodiments, the controller CON, the power supply PS, and the first compensator CP1 may be embedded in the second circuit board PCB2, as illustrated in FIG. 4A, but the positions of the controller CON, the power supply PS, and the first compensator CP1 are not limited thereto. For example, the controller CON, the power supply PS, and the first compensator CP1 may be embedded in the first circuit board PCB1, as illustrated in FIG. 4B. In this case, the display device DD may include none of the cable CONN and the second circuit board PCB2 illustrated in FIG. 4A.

Also, the positions of the controller CON, the power supply PS, and/or the first compensator CP1 may be variously changed according to some embodiments. For example, the controller CON may alternatively be embedded in a circuit board that is different from a circuit board (e.g., the first circuit board PCB1 or the second circuit board PCB2) in which the power supply PS and/or the first compensator CP1 are(is) embedded.

Further, FIGS. 4A and 4B illustrate embodiments in which the controller CON, the power supply PS, and the first compensator CP1 are provided as individual components, but embodiments according to the present disclosure are not limited thereto. For example, at least two of the controller CON, the power supply PS, and the first compensator CP1 may be configured as a single integrated circuit. For example, the first compensator CP1 may be provided inside the controller CON.

According to some embodiments of the present disclosure, an input power line VLI may be formed to pass through the gate circuit boards GFPC, and may be connected to the gate integrated circuits GIC. For example, as in the embodiments described with respect to FIG. 4A, the input power line VLI extends so as to start from the power supply PS and to sequentially pass through the second circuit board PCB2, the cable CONN, the first circuit board PCB1, any one of (or one or more of) the data circuit boards DFPC, and the plurality of (e.g., each of the plurality of) gate circuit boards GFPC, and may pass through the non-display area NA of the display panel DPN between the adjacent gate circuit boards GFPC and/or in the vicinity (e.g., in the non-display area NA of the display panel DPN and between the adjacent gate circuit boards GFPC along a horizontal direction) thereof. Alternatively, as in the embodiments described with respect to FIG. 4B, the input power line VLI extends so as to start from the power supply PS and to sequentially pass through the first circuit board PCB1, any one of the data circuit boards DFPC, and the plurality of gate circuit boards GFPC, and may pass through the non-display area NA of the display panel DPN between the adjacent gate circuit boards GFPC and/or in the vicinity (e.g., in the non-display area NA of the display panel DPN and between the adjacent gate circuit boards GFPC along a horizontal direction) thereof.

As described above, in case that the input power line VLI is formed to pass through the gate circuit boards GFPC, the size of the non-display area NA of the display panel DPN may be reduced. For example, in systems in which the input power line VLI is formed to extend along one direction (e.g., a longitudinal direction) in the display panel DPN, because the input power line VLI is formed in the non-display area NA between the display area DA and the gate circuit boards GFPC, the width (e.g., the width in a lateral direction) of the non-display area NA may need to be increased in order to provide a sufficient wiring space for forming or arranging the input power line VLI. On the other hand, in case that the input power line VLI is formed to pass through the gate circuit boards GFPC, according to some embodiments of the present disclosure, the input power line VLI may be formed between the gate circuit boards GFPC and in the non-display area NA within the range corresponding to the width of a gate bonding area, to which the gate circuit boards GFPC are bonded. Accordingly, the input power line VLI may be connected to the gate integrated circuits GIC without providing an additional wiring space between the display area DA and the gate circuit boards GFPC. Thus, the overall footprint of the non-display area NA may be relatively reduced.

Meanwhile, in systems in which the input power line VLI is formed to sequentially pass through the gate circuit boards GFPC, the length of the input power line VLI may increase, which may further tend to increase the resistance thereof of the input power line VLI. Also, the resistance of the input power line VLI may increase due to bonding resistance caused in a part (e.g., gate pads) in which the gate circuit boards GFPC are coupled to the display panel DPN.

Accordingly, some embodiments of the present disclosure may be configured to detect the voltage drop of a gate input voltage GVIN caused in the input power line VLI by connecting a feedback power line FBL to the input power line VLI, and the voltage drop of the gate input voltage GVIN may be compensated for by changing the voltage level of the gate input voltage GVIN output from the power supply PS in case that the voltage drop of the gate input voltage GVIN is equal to or greater than a set value.

For example, the feedback power line FBL may be connected to at least one gate input power line VLI. The feedback power line FBL may be formed to pass through the gate circuit boards GFPC, like the input power line VLI. Accordingly, an increase in the size of the non-display area NA by the feedback power line FBL may be prevented, reduced, or minimized.

According to some embodiments, the feedback power line FBL may be connected to the input power line VLI corresponding thereto inside the last gate circuit board GFPC located farthest from the power supply PS (e.g., the gate circuit board GFPC located at the top) or in the vicinity of (or at) the last gate circuit board GFPC. Accordingly, the voltage drop of the gate input voltage GVIN caused in the input power line VLI may be effectively detected.

For example, the feedback power line FBL may be connected to the first compensator CP1 after sequentially passing through the gate circuit boards GFPC, any one of the data circuit boards DFPC, the first circuit board PCB1, the cable CONN, and the second circuit board PCB2. Accordingly, when it is compared with the gate input voltage GVIN output from the power supply PS, the feedback voltage FBV, the voltage level of which is changed (e.g., decreased) by the voltage drop caused in the input power line VLI and the feedback power line FBL, may be input to the first compensator CP1. For example, the feedback voltage FBV, which corresponds to the gate input voltage GVIN, the voltage level of which is changed by about two times the voltage drop caused in each input power line VLI, may be input to the first compensator CP1.

The first compensator CP1 may be connected to the feedback power line FBL, and may output a compensation signal CPS in response to the feedback voltage FBV transferred from the feedback power line FBL. The compensation signal CPS may be input to the controller CON.

The controller CON may output a power control signal PCS to the power supply PS in response to the compensation signal CPS. For example, the controller CON may output a power control signal PCS based on which the power supply PS is controlled to compensate for the voltage drop of the gate input voltage GVIN. The power control signal PCS may be input to the power supply PS.

The power supply PS may adjust the voltage level of the gate input voltage GVIN in response to the power control signal PCS. For example, the power supply PS may output the gate input voltage GVIN after raising the voltage level thereof in response to the power control signal PCS. The gate input voltage GVIN, the voltage level of which is changed, may be output to the input power line VLI.

Accordingly, even though a voltage drop may be caused or occur in the input power line VLI, a gate input voltage GVIN having a voltage level through which the gate integrated circuits GIC are capable of being stably driven may be input to the gate integrated circuits GIC.

Figure 5:
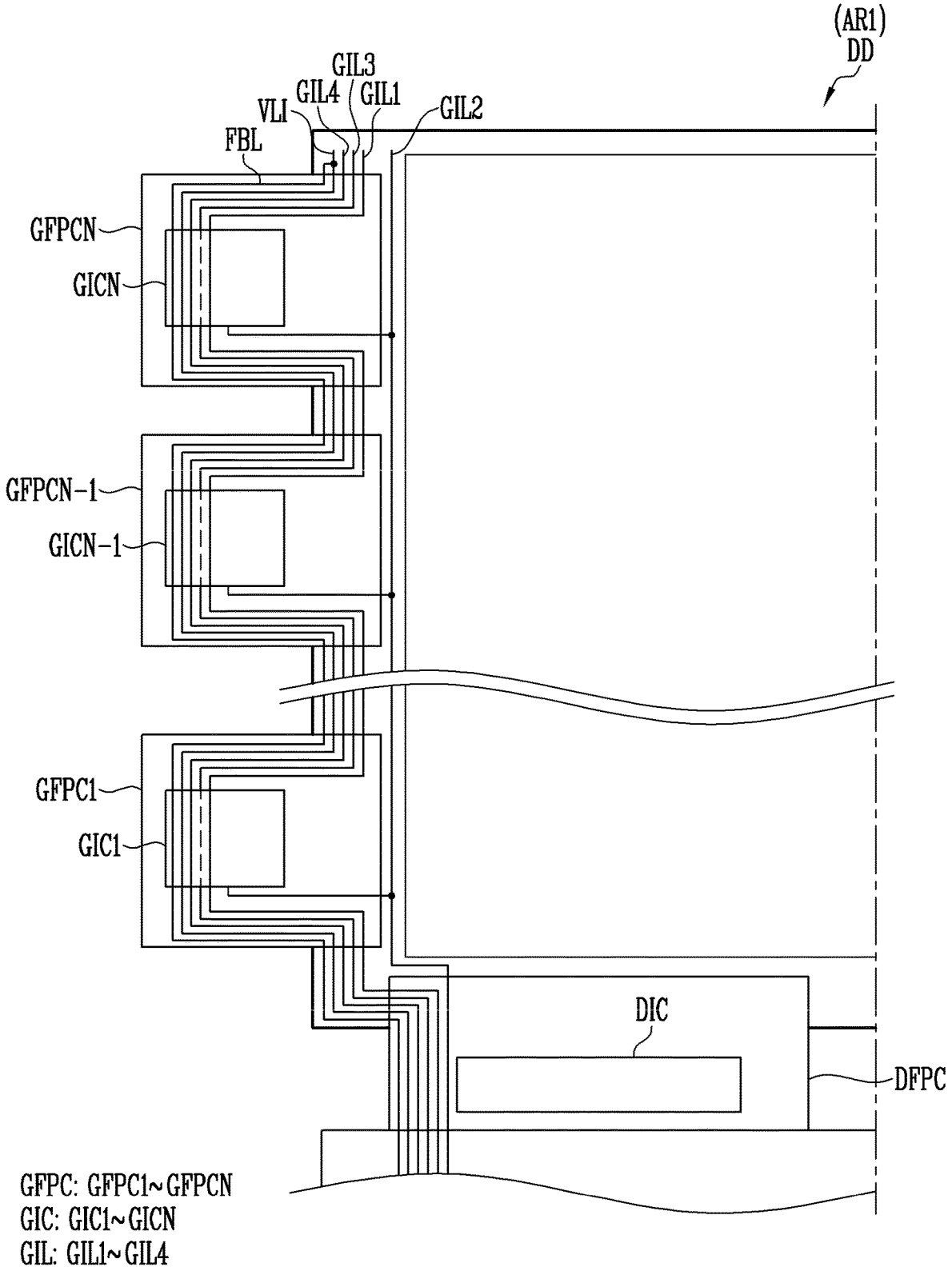
FIG. 5 is a plan view illustrating gate input lines and a feedback power line of a display device according to some embodiments of the present disclosure.

FIG. 5 is a plan view illustrating the gate input lines and the feedback power line FBL of a display device DD according to some embodiments of the present disclosure. For example, FIG. 5 illustrates one area of the display device DD corresponding to the first area AR1 of FIGS. 4A and 4B.

Referring to FIGS. 1 to 5, the display device DD may include first to N-th gate integrated circuits GIC1 to GICN, configured to output gate signals to pixels PXL through gate lines GL, and gate input lines, connected to the first to N-th gate integrated circuits GIC1 to GICN (and/or passing through the first to N-th gate integrated circuits GIC1 to GICN).

The first to N-th gate integrated circuits GIC1 to GICN may be embedded in first to N-th gate circuit boards GFPC1 to GFPCN, respectively. The gate input lines may be formed to pass through the first to N-th gate circuit boards GFPC1 to GFPCN.

The gate input lines may include at least one gate input power line VLI (referred to as an "input power line") and at least one gate input signal line GIL (referred to as an "input signal line") for respectively transferring each gate input voltage GVIN and each gate control signal GCS to the gate integrated circuits GIC.

For example, the gate input lines may include at least one gate input power line VLI for transferring each gate input voltage GVIN to the gate integrated circuits GIC and a plurality of gate input signal lines GIL for delivering a plurality of gate control signals GCS to the gate integrated circuits GIC.

According to some embodiments, each of the gate integrated circuits GIC may be driven by a plurality of gate input voltages GVIN. In this case, the display device DD may include a plurality of input power lines VLI.

A feedback power line FBL may be connected to at least one gate input power line VLI. For example, the display device DD may include a single feedback power line FBL connected to any one input power line VLI, or may include a plurality of feedback power lines FBL respectively connected to at least two input power lines VLI. Through each of the feedback power lines FBL, the gate input voltage GVIN supplied through the input power line VLI connected to the feedback power line FBL may be fed back to the first compensator CP1.

According to some embodiments, at least one gate input line (e.g., a second gate signal line GIL2) is formed to extend along one direction in the display panel DPN, and may be connected to each of the gate integrated circuits GIC though each of the gate circuit boards GFPC. Accordingly, the length of the at least one gate input line may be reduced or minimized, and the bonding resistance may be reduced or minimized. Accordingly, the voltage drop and/or the signal delay (e.g., RC delay) caused in the at least one gate input line may be minimized.

The remaining gate input lines, excluding the at least one gate input line, may be formed to pass through the first to N-th gate circuit boards GFPC1 to GFPCN. Accordingly, the size of the non-display area NA of the display panel DPN may be reduced.

For example, at least one gate input power line VLI, a first gate input signal line GIL1, a third gate input signal line GIL3, and/or a fourth gate input signal line GIL4 may be formed to pass through the first to N-th gate circuit boards GFPC1 to GFPCN, and the second gate input signal line GIL2 may be formed in the non-display area NA of the display panel DPN so as to be located between the display area DA and the first to N-th gate circuit boards GFPC1 to GFPCN.

According to some embodiments, the first gate input signal line GIL1 and the second gate input signal line GIL2 may be gate input signal lines GIL for delivering gate control signals GCS that are synchronized with each other and have waveforms substantially the same as or similar to each other. For example, the first gate input signal line GIL1 and the second gate input signal line GIL2 may be gate input signal lines GIL for delivering a first clock signal and a second clock signal, respectively. The remaining gate input signal lines GIL may be gate input signal lines GIL for delivering gate control signals GCS that are different from the gate control signals GCS input to the first gate input signal line GIL1 and the second gate input signal line GIL2. For example, the third gate input signal line GIL3 and the fourth gate input signal line GIL4 may be gate input signal lines GIL for delivering a gate start pulse and a gate output enable signal, respectively.

In case that the third gate input signal line GIL3 is a gate input signal line GIL for delivering a gate start pulse, the third gate input signal line GIL3 may be connected through stages in each of the gate integrated circuits GIC. For example, the third gate input signal line GIL3 is connected between two stages configured to sequentially generate output signals in each of the gate integrated circuits GIC, thereby delivering the output signal of the previous stage to the next stage as the input signal of the next stage. Also, the third gate input signal line GIL3 is connected between adjacent gate integrated circuits GIC via the gate circuit boards GFPC in which the adjacent gate integrated circuits GIC are embedded, thereby delivering the output signal output from the previous gate integrated circuit GIC to the next gate integrated circuit GIC.

According to some embodiments, the second gate input signal line GIL2 may be a gate input signal line GIL for delivering a gate control signal GCS that more sensitively affects the operations of the gate integrated circuits GIC. For example, the second gate input signal line GIL2 may be a gate input signal line GIL for delivering a gate start pulse to the gate integrated circuits GIC. In this case, the second gate input signal line GIL2 may deliver the gate start pulse to the first gate integrated circuit GIC1 by being connected thereto, and at least one subline for delivering the output signal of the previous stage or the previous gate integrated circuit GIC to the next stage or the next gate integrated circuit GIC may be formed between the stages and/or between the adjacent gate integrated circuits GIC.

In case that the second gate input signal line GIL2 is a gate input signal line GIL for delivering a gate start pulse, the first gate input signal line GIL1, the third gate input signal line GIL3, and/or the fourth gate input signal line GIL4 may be gate input signal lines GIL for delivering the remaining gate control signals GCS to the gate integrated circuits GIC. For example, the first gate input signal line GIL1, the third gate input signal line GIL3, and the fourth gate input signal line GIL4 may be gate input signal lines GIL for delivering a first clock signal, a second clock signal, and a gate output enable signal, respectively.

Figure 6:
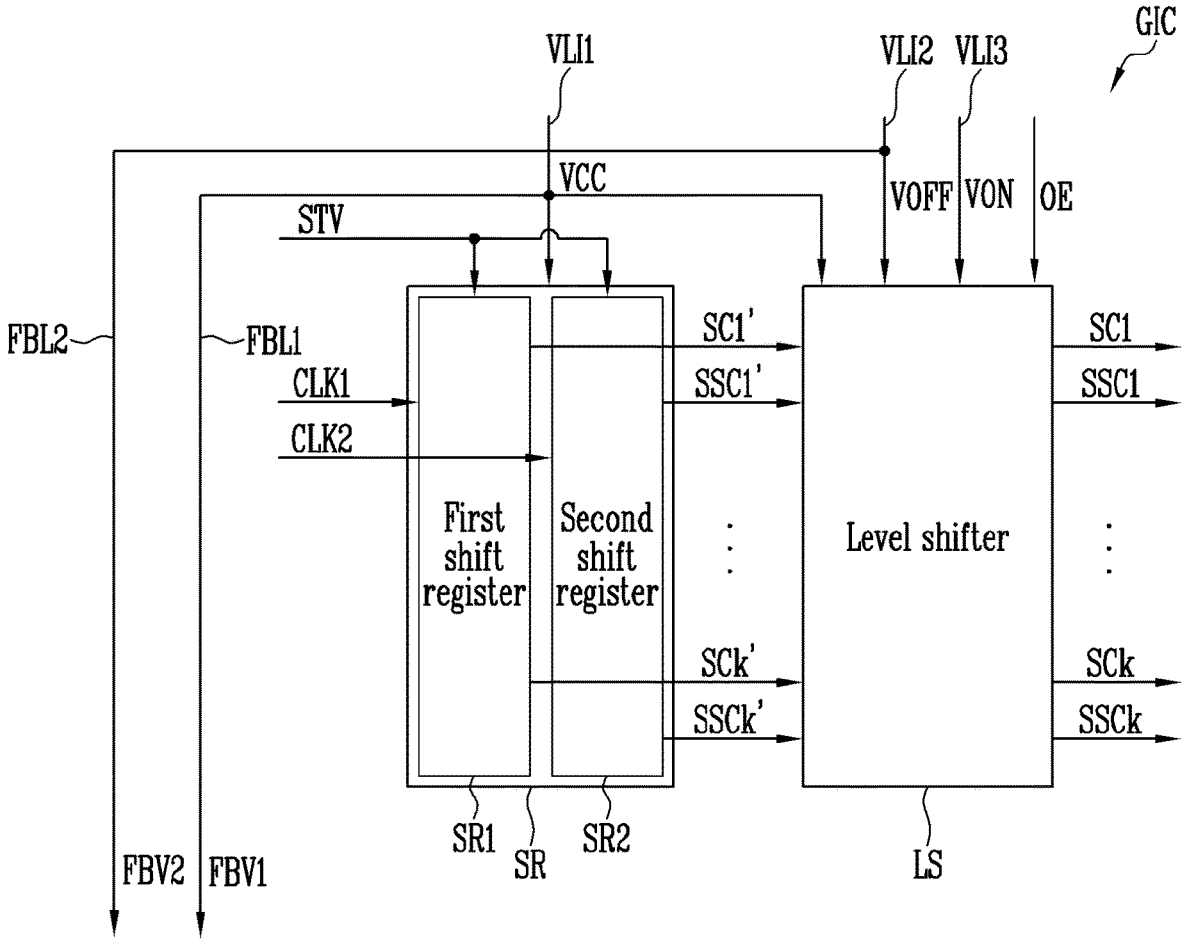
FIG. 6 is a block diagram illustrating a gate integrated circuit according to some embodiments of the present disclosure.

FIG. 6 is a block diagram illustrating a gate integrated circuit GIC according to some embodiments of the present disclosure.

Referring to FIGS. 1 to 6, a gate integrated circuit GIC may include a shift register SR and a level shifter LS. According to some embodiments, the shift register SR may be driven by an operating voltage VCC, a gate start pulse STV, a first clock signal CLK1, and a second clock signal CLK2, and the level shifter LS may be driven by the output signals SC' and SSC' of the shift register SR, a gate output enable signal OE, an operating voltage VCC, a gate-on voltage VON, and a gate-off voltage VOFF. In this case, gate input voltages GVIN may include the operating voltage VCC, the gate-on voltage VON, and the gate-off voltage VOFF, and gate control signals GCS may include the gate start pulse STV, the first clock signal CLK1, the second clock signal CLK2, and the gate output enable signal OE.

The configurations of the gate integrated circuit GIC, the shift register SR, and/or the level shifter LS may be variously changed according to some embodiments. Also, the types and/or number of gate input voltages GVIN and gate control signals GCS for driving the gate integrated circuit GIC, the shift register SR, and/or the level shifter LS may be variously changed depending on the configuration of the gate integrated circuit GIC.

According to some embodiments, the gate integrated circuit GIC may configure a scan driver SDR. In this case, the gate integrated circuit GIC may output scan signals SC.

According to some embodiments, the gate integrated circuit GIC may further output control signals SSC. In this case, the gate integrated circuit GIC may include a first shift register SR1, including stages for outputting scan signals SC (e.g., stages connected dependently to the input terminal to which a gate start pulse STV (or the output signal of the previous gate integrated circuit GIC) is input), and a second shift register SR2, including stages for outputting control signals SSC (e.g., stages connected dependently to the input terminal to which the gate start pulse STV (or the output signal of the previous gate integrated circuit GIC) is input). According to some embodiments, the first shift register SR1 and the second shift register SR2 may be driven independently. Also, the first shift register SR1 and the second shift register SR2 may be simultaneously driven, but are not limited thereto.

The shift register SR may be supplied with an operating voltage VCC, a gate start pulse SW, a first clock signal CLK1, and a second clock signal CLK2. The shift register SR may sequentially shift the gate start pulse STV using the first and second clock signals CLK1 and CLK2 and output the same to the respective output lines.

According to some embodiments, the shift register SR may include a first shift register SR1 driven by the first clock signal CLK1 and a second shift register SR2 driven by the second clock signal CLK2. Meanwhile, each of the first shift register SR1 and the second shift register SR2 is illustrated as being driven by a single clock signal in FIG. 6, but the number and/or types of clock signals input to each of the first shift register SR1 and the second shift register SR2 may be variously changed according to some embodiments. For example, the first shift register SR1 may be driven by a plurality of clock signals including the first clock signal CLK1, and the second shift register SR2 may be driven by a plurality of clock signals including the second clock signal CLK2.

According to some embodiments, in case that k horizontal lines (e.g., k pixel rows) are arranged in the display area DA (k being a natural number equal to or greater than 2), the first shift register SR1 includes k stages driven by at least one clock signal including the first clock signal CLK1 and sequentially shifts a gate start pulse SW using the at least one clock signal, thereby sequentially generating k output signals SC1' to SCk'. Similarly, the second shift register SR2 includes k different stages driven by at least one clock signal including the second clock signal CLK2 and sequentially shifts a gate start pulse STV using the at least one clock signal, thereby sequentially generating k output signals SSC1' to SSCk'.

According to some embodiments, the first shift register SR1 and the second shift register SR2 may be driven by the same gate start pulse SW, or may be driven by different gate start pulses STV. In case that the first shift register SR1 and the second shift register SR2 are driven by different gate start pulses STV, the display device DD may include a plurality of gate input lines for individually supplying a plurality of gate start pulses SW to the shift register SR.

According to some embodiments, the stages forming the first shift register SR1 and the stages forming the second shift register SR2 may be alternately arranged in the shift register SR, in which the first and second shift registers SR1 and SR2 are included. However, embodiments according to the present disclosure are not limited thereto. For example, according to some embodiments, the stages forming the first shift register SR1 and the stages forming the second shift register SR2 may be arranged in parallel. Also, the positions and/or arrangement structure of the stages provided in the shift register SR may be variously changed.

According to some embodiments, the first shift register SR1 sequentially shifts a gate start pulse STV (or the output signal of the first shift register SR1 included in the previous gate integrated circuit GIC) using at least one clock signal including the first clock signal CLK1, thereby sequentially outputting output signals (e.g., SC1' to SCk') to the odd-numbered output lines of the shift register SR (or the first output lines of the shift register SR). The second shift register SR2 sequentially shifts a gate start pulse SW (or the output signal of the second shift register SR2 included in the previous gate integrated circuit GIC) using at least one clock signal including the second clock signal CLK2, thereby sequentially outputting output signals (e.g., SSC1' to SSCk') to the even-numbered output lines of the shift register SR (or the second output lines of the shift register SR).

Each of the stages forming the first and second shift registers SR1 and SR2 may shift the gate start pulse SW or the output signal supplied from the previous stage (referred to as a "carry signal") using at least one clock signal (e.g., the first clock signal CLK1 or the second clock signal CLK2) supplied thereto and output the same to each output line. For example, the stages of the first shift register SR1 may sequentially shift the gate start pulse STV using the first clock signal CLK1, and the stages of the second shift register SR2 may sequentially shift the gate start pulse SW using the second clock signal CLK2.

Meanwhile, in the above-described embodiments, respective stages or a plurality of stages (e.g., the stages of the first shift register SR1 or the second shift register SR2) for generating any one type of signals (e.g., signals SC' used to generate scan signals SC or signals SSC' used to generate control signals SSC) are described as being driven by any one clock signal (e.g., the first clock signal CLK1 or the second clock signal CLK2), but the present disclosure is not limited thereto. For example, the respective stages or the plurality of stages for generating any one type of signals may be driven by a plurality of clock signals having different phases and/or waveforms.

According to some embodiments, the second clock signal CLK2 may have substantially the same waveform as the first clock signal CLK1. For example, for the display period of the display device DD, the first clock signal CLK1 and the second clock signal CLK2, which have the same waveforms, may be respectively input to the first shift register SR1 and the second shift register SR2. In this case, the first shift register SR1 and the second shift register SR2 may be driven simultaneously, and each scan signal SC and each control signal SSC may be simultaneously supplied to the pixels PXL of each horizontal line. The configuration of the shift register SR and the types and/or number of clock signals input to the shift register SR may be variously changed according to some embodiments.

The output signals SC' and SSC' of the shift register SR may be input to the level shifter LS.

The level shifter LS may change the voltage levels of the output signals SC' and SSC' of the shift register SR using a gate-on voltage VON and a gate-off voltage VOFF, and may output the signals, the voltage levels of which are changed, to the gate lines GL as gate signals. According to some embodiments, the gate signals may include scan signals SC and control signals SSC. In this case, the level shifter LS may output the scan signals SC and the control signals SSC to the scan signals SL and the control lines SSL, respectively.

For example, the level shifter LS may change the logic-high voltages of the output signals of the first shift register SR1 (e.g., SC1' to SCk') to gate-on voltages VON and sequentially output the same to the scan lines SL as scan signals SC. Also, the level shifter LS may change the logic-low voltages of the output signals of the first shift register SR1 (e.g., SC1' to SCk') to gate-off voltages VOFF and sequentially output the same to the scan lines SL.

Additionally, the level shifter LS may change the logic-high voltages of the output signals of the second shift register SR2 (e.g., SSC1' to SSCk') to gate-on voltages VON and sequentially output the same to the control lines SSL as control signals SSC. Also, the level shifter LS may change the logic-low voltages of the output signals of the second shift register SR2 (e.g., SSC1' to SSCk') to gate-off voltages VOFF and sequentially output the same to the control lines SSL.

Each gate input voltage GVIN may be input from the power supply PS to the gate integrated circuit GIC through each gate input power line VLI. According to some embodiments, the gate input power line VLI may include a first gate input power line VLI1 for transferring a first gate input voltage, a second gate input power line VLI2 for transferring a second gate input voltage, and a third gate input power line VLI3 for transferring a third gate input voltage.

According to some embodiments, the first gate input voltage, the second gate input voltage, and the third gate input voltage may be the operating voltage VCC of the gate integrated circuits GIC (referred to as the "operating voltage of the shift register SR and/or the level shifter LS), a gate-off voltage VOFF, and a gate-on voltage VON, respectively. For example, the power supply PS may output the operating voltage VCC of the gate integrated circuits GIC, the gate-off voltage VOFF, and the gate-on voltage VON to the first gate input power line VLI1, the second gate input power line VLI2, and the third gate input power line VLI3, respectively. According to some embodiments, the first gate input power line VLI1, the second gate input power line VLI2, and the third gate input power line VLI3 may be connected to the gate integrated circuits GIC via gate circuit boards GFPC.

According to some embodiments of the present disclosure, each feedback power line FBL may be connected to at least one gate input power line VLI to which at least one gate input voltage GVI, which more sensitively affects the operation of the gate integrated circuits GIC, is input. The at least one gate input voltage GVIN may be fed back to the first compensator CP1 through the feedback power line FBL.

For example, the feedback power line FBL may include a first feedback power line FBL1 connected to the first gate input power line VLI1 and a second feedback power line FBL2 connected to the second gate input power line VLI2. Accordingly, the operating voltage VCC input from the power supply PS to the gate integrated circuits GIC through the first gate input power line VLI1 may be input to the first compensator CP1 through the first feedback power line FBL1 as a first feedback voltage FBV1. Also, the gate-off voltage VOFF input from the power supply PS to the gate integrated circuits GIC through the second gate input power line VLI2 may be input to the first compensator CP1 through the second feedback power line FBL2 as a second feedback voltage FBV2.

The respective feedback power lines FBL may be connected to the first compensator CP1 via the gate circuit boards GFPC. For example, the first feedback power line FBL1 may be connected to the first comparator of the first compensator CP1 (e.g., the first comparator CPR1 of FIG. 7) via the gate circuit boards GFPC, and the second feedback power line FBL2 may be connected to the second comparator of the first compensator CP1 (e.g., the second comparator CPR2 of FIG. 7) via the gate circuit boards GFPC.

The first compensator CP1 may output a first compensation signal for compensating for the voltage drop of the first gate input voltage (e.g., the operating voltage VCC) based on the first feedback voltage FBV1. Also, the first compensator CP1 may output a second compensation signal for compensating for the voltage drop of the gate-off voltage VOFF based on the second feedback voltage FBV2.

According to some embodiments, the first feedback power line FBL1 may be connected to the first gate input power line VLI1 in the vicinity of (or at) the gate integrated circuit GIC located farthest from the power supply PS. For example, the first gate integrated circuit GIC1 may be connected to the power supply PS via the first gate circuit board GFPC1 located closest to the power supply PS, among the gate circuit boards GFPC, and the N-th gate integrated circuit GICN may be located farthest from the power supply PS, among the gate integrated circuits GIC, and may be connected to the power supply PS via the first to N-th gate circuit boards GFPC1 to GFPCN. In this case, the first feedback power line FBL1 may be connected to the first gate input power line VLI1 in the vicinity of (or at) the N-th gate integrated circuit GICN (e.g., in the vicinity of the output terminal of the N-th gate integrated circuit GICN), and may be connected to the first compensator CP1 via the first to N-th gate circuit boards GFPC1 to GFPCN. Accordingly, the voltage drop of the first gate input voltage (e.g., the operating voltage VCC) may be effectively detected.

Similarly, the second feedback power line FBL2 may be connected to the second gate input power line VLI2 in the vicinity of (or at) the N-th gate integrated circuit GICN, and may be connected to the first compensator CP1 via the first to N-th gate circuit boards GFPC1 to GFPCN. Accordingly, the voltage drop of the second gate input voltage (e.g., the gate-off voltage VOFF) may be effectively detected.

The respective gate control signals GCS may be input to the gate integrated circuits GIC through the respective gate input signal lines GIL. For example, each of the gate start pulse STV, the first clock signal CLK1, the second clock signal CLK2, and the gate output enable signal OE may be input to the gate integrated circuit GIC through any one of the first to fourth gate input signal lines GIL1 to GIL4.

Figure 7:
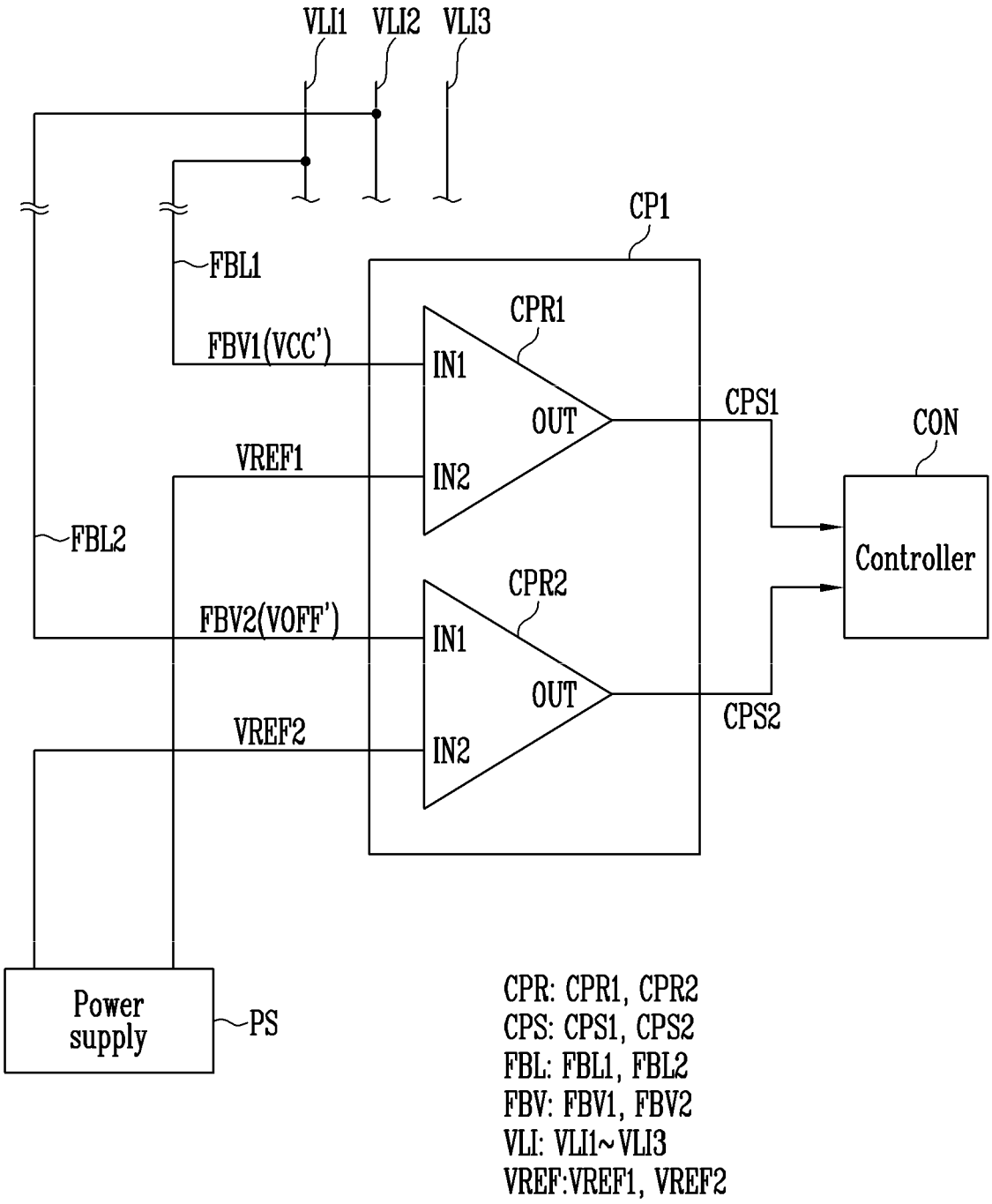
FIG. 7 is a block diagram illustrating a first compensator according to some embodiments of the present disclosure.

FIG. 7 is a block diagram illustrating a first compensator CP1 according to some embodiments of the present disclosure.

Referring to FIGS. 1 to 7, the first compensator CP1 may receive at least one gate input voltage GVIN as feedback, and may output at least one compensation signal CPS in response to a feedback voltage FBV. For example, the first compensator CP1 may be connected to a first feedback power line FBL1, and may output a first compensation signal CPS1 in response to a first feedback voltage FBV1 transferred from the first feedback power line FBL1. Also, the first compensator CP1 may optionally be further connected to a second feedback power line FBL2. For example, the first compensator CP1 may be connected to the second feedback power line FBL2, and may output a second compensation signal CPS2 in response to a second feedback voltage FBV2 transferred from the second feedback power line FBL2.

The first compensator CP1 may include at least one comparator CPR. For example, the first compensator CP1 may include a first comparator CPR1 configured to output the first compensation signal CPS1 in response to the first feedback voltage FBV1 and a second comparator CPR2 configured to output the second compensation signal CPS2 in response to the second feedback voltage FBV2.

The first comparator CPR1 may include a first input terminal IN1 connected to the first feedback power line FBL1, a second input terminal IN2 connected to the power supply PS, and an output terminal OUT connected to the controller CON. According to some embodiments, the first gate input voltage GVIN1, which is dropped by passing through the first gate input power line VLI1 and the first feedback power line FBL1 (e.g., the dropped operating voltage VCC' of the gate integrated circuits GIC), may be input to the first input terminal IN1 of the first comparator CPR1 as the first feedback voltage FBV1. A first reference voltage VREF1 output from the power supply PS may be input to the second input terminal IN2 of the first comparator CPR1.

The first comparator CPR1 may output the first compensation signal CPS1 depending on the voltage difference between the first feedback voltage FBV1 and the first reference voltage VREF1. For example, the first comparator CPR1 may output the first compensation signal CPS1 having a logic-high voltage to the controller CON in case that the voltage difference between the first feedback voltage FBV1 and the first reference voltage VREF1 is equal to or greater than a first set value (a predetermined first setting voltage).

The first reference voltage VREF1 may be a voltage corresponding to the first gate input voltage GVIN1. Also, the first reference voltage VREF1 may be a reference voltage that is set in consideration of the amount of voltage drop caused in the first gate input power line VLI1 and the first feedback power line FBL1.

For example, the first reference voltage VREF1 may be the effective value of the operating voltage VCC of the gate integrated circuits GIC, which is generated in the power supply PS. The first feedback voltage FBV1 may have a voltage lower than the first gate input voltage GVIN1 generated in the power supply PS by the amount of voltage drop caused in the first gate input power line VLI1 and the first feedback power line FBL1. For example, the first feedback voltage FBV1 may be a voltage lower than the first gate input voltage GVIN1 generated in the power supply PS by about two times the amount of voltage drop caused in the first gate input power line VLI1. Accordingly, in case that the voltage drop of the first gate input voltage GVIN1 is compensated for based on the voltage difference between the first feedback voltage FBV1 and the first reference voltage VREF1, the voltage drop of the first gate input voltage GVIN1 may be compensated for with a voltage margin that is sufficient to stably drive the gate integrated circuits GIC.

The controller CON may control the first gate input voltage GVIN1 output from the power supply PS (e.g., the operating voltage VCC of the gate integrated circuits GIC output from the power supply PS) in response to the first compensation signal CPS1. For example, the controller CON may output a power control signal PCS, based on which control is performed to change the first gate input voltage GVIN1 in response to the logic-high first compensation signal CPS1, to the power supply PS. For example, the controller CON may output a power control signal PCS, based on which control is performed to increase the first gate input voltage GVIN1 in response to the logic-high first compensation signal CPS1, to the power supply PS.

The second comparator CPR2 may include a first input terminal IN1 connected to the second feedback power line FBL2, a second input terminal IN2 connected to the power supply PS, and an output terminal OUT connected to the controller CON. According to some embodiments, a second gate input voltage, which is dropped by passing through the second gate input power line VLI2 and the second feedback power line FBL2, may be input to the first input terminal IN1 of the second comparator CPR2 as the second feedback voltage FBV2. A second reference voltage VREF2 output from the power supply PS may be input to the second input terminal IN2 of the second comparator CPR2.

The second gate input voltage may be any one of a gate-off voltage VOFF and a gate-on voltage VON, which are used to generate gate signals by being input to the gate integrated circuits GIC. Also, the second gate input voltage may be a voltage that more significantly affects the operation characteristics of the gate integrated circuits GIC, among the gate-off voltage VOFF and the gate-on voltage VON. For example, the second gate input voltage may be the gate-off voltage VOFF. In this case, the gate-off voltage VOFF', which is dropped by passing through the second gate input power line VLI2 and the second feedback power line FBL2, may be input to the first input terminal IN1 of the second comparator CPR2 as the second feedback voltage FBV2.

The second comparator CPR2 may output the second compensation signal CPS2 depending on the voltage difference between the second feedback voltage FBV2 and the second reference voltage VREF2. For example, the second comparator CPR2 may output the second compensation signal CPS2 having a logic-high voltage to the controller CON in case that the voltage difference between the second feedback voltage FBV2 and the second reference voltage VREF2 is equal to or greater than a second set value (a predetermined second setting voltage).

The second reference voltage VREF2 may be a voltage corresponding to the second gate input voltage. Also, the second reference voltage VREF2 may be a reference voltage that is set in consideration of the amount of voltage drop caused in the second gate input power line VLI2 and the second feedback power line FBL2.

For example, the second reference voltage VREF2 may be the effective value of the gate-off voltage VOFF generated in the power supply PS. The second feedback voltage FBV2 may have a voltage lower than the second gate input voltage generated in the power supply PS by the amount of voltage drop caused in the second gate input power line VLI2 and the second feedback power line FBL2. For example, the second feedback voltage FBV2 may be a voltage lower than the second gate input voltage generated in the power supply PS by about two times the amount of voltage drop caused in the second gate input power line VLI2. Accordingly, in case that the voltage drop of the second gate input voltage is compensated for based on the voltage difference between the second feedback voltage FBV2 and the second reference voltage VREF2, the voltage drop of the second gate input voltage may be compensated for with a voltage margin that is sufficient to stably drive the gate integrated circuits GIC.

The controller CON may control the second gate input voltage output from the power supply PS (e.g., the gate-off voltage VOFF output from the power supply PS) in response to the second compensation signal CPS2. For example, the controller CON may output a power control signal PCS, based on which control is performed to change the second gate input voltage in response to the logic-high second compensation signal CPS2, to the power supply PS. For example, the controller CON may output a power control signal PCS, based on which control is performed to increase the second gate input voltage in response to the logic-high second compensation signal CPS2, to the power supply PS.

The power supply PS may adjust the voltage level of the first gate input voltage GVIN1 and/or the second gate input voltage in response to the power control signal PCS and output the first gate input voltage GVIN and/or the second gate input voltage. For example, the power supply PS may output the first gate input voltage GVIN1 after raising the voltage level thereof in response to the power control signal PCS dictating the rise of the first gate input voltage GVIN1, and may output the second gate input voltage after raising the voltage level thereof in response to the power control signal PCS dictating the rise of the second gate input voltage. Accordingly, the voltage drop of the first gate input voltage GVIN1 and/or the second gate input voltage may be compensated for, whereby the gate integrated circuits GIC may be driven more stably.

According to some embodiments, the power supply PS may output the first gate input voltage GVIN1 to the controller CON, and the controller CON may generate at least one gate control signal GCS, including a first gate control signal, using the first gate input voltage GVIN1. For example, the power supply PS may output the operating voltage VCC of the gate integrated circuits GIC to the controller CON. Also, the controller CON may generate a first clock signal CLK1 as the first gate input voltage GVIN1 using the operating voltage VCC of the gate integrated circuits GIC, which is input from the power supply PS, and may output the first clock signal CLK1 to the first gate input signal line GIL1. Also, the controller CON may further generate at least one of a gate start pulse SW, a second clock signal CLK2, or a gate output enable signal OE respectively as the second gate input voltage, the third gate input voltage, and the fourth gate input voltage, using the operating voltage VCC of the gate integrated circuits GIC, which is input from the power supply PS.

Accordingly, when the voltage drop of the first gate input voltage GVIN1 is compensated for, the voltage drop caused or occurring in at least one gate input signal line GIL, including the first gate input signal line GIL1, may also be compensated for. Accordingly, the voltage drop of at least one gate control signal GCS, including the first gate control signal, may also be compensated for. Accordingly, the gate integrated circuits GIC may be driven more stably, and the output characteristics of the gate integrated circuits GIC may be made uniform.

Meanwhile, FIG. 7 illustrates embodiments in which a plurality of gate input voltages GVIN (e.g., the first and second gate input voltages GVIN1 and GVIN2) are respectively fed back, whereby the voltage drops of the plurality of gate input voltages GVIN are compensated for. However, embodiments according to the present disclosure are not limited thereto. For example, according to some embodiments, only a single gate input voltage is fed back, and the voltage drop of at least one gate input voltage GVIN, including the single gate input voltage GVIN, may be compensated for. In this case, the first compensator CP1 may include only a single comparator CPR (e.g., the first comparator CPR1 or the second comparator CPR2).

Figure 8:
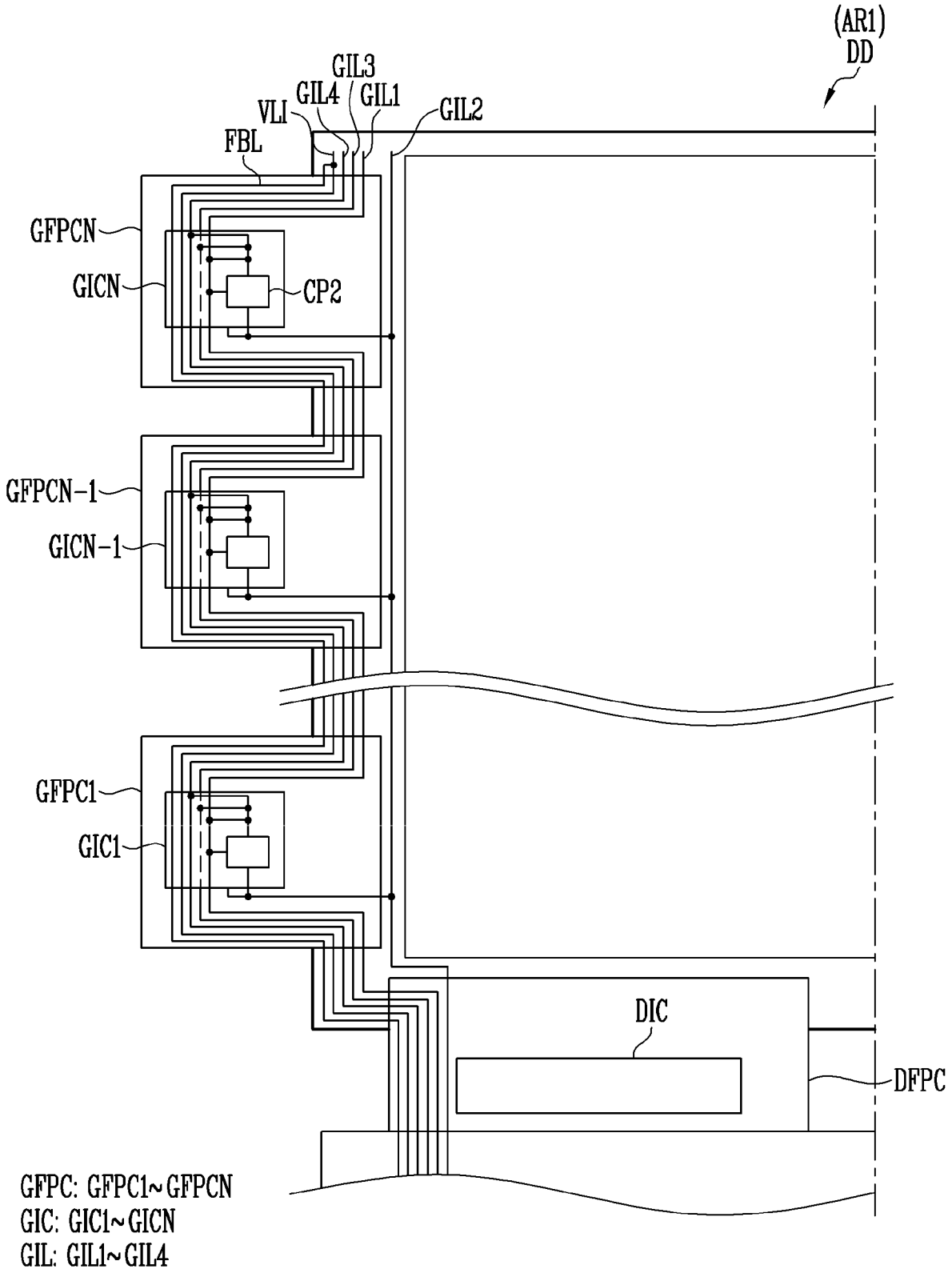
FIG. 8 is a plan view illustrating gate input lines and a feedback power line of a display device according to some embodiments of the present disclosure.
Figure 9:
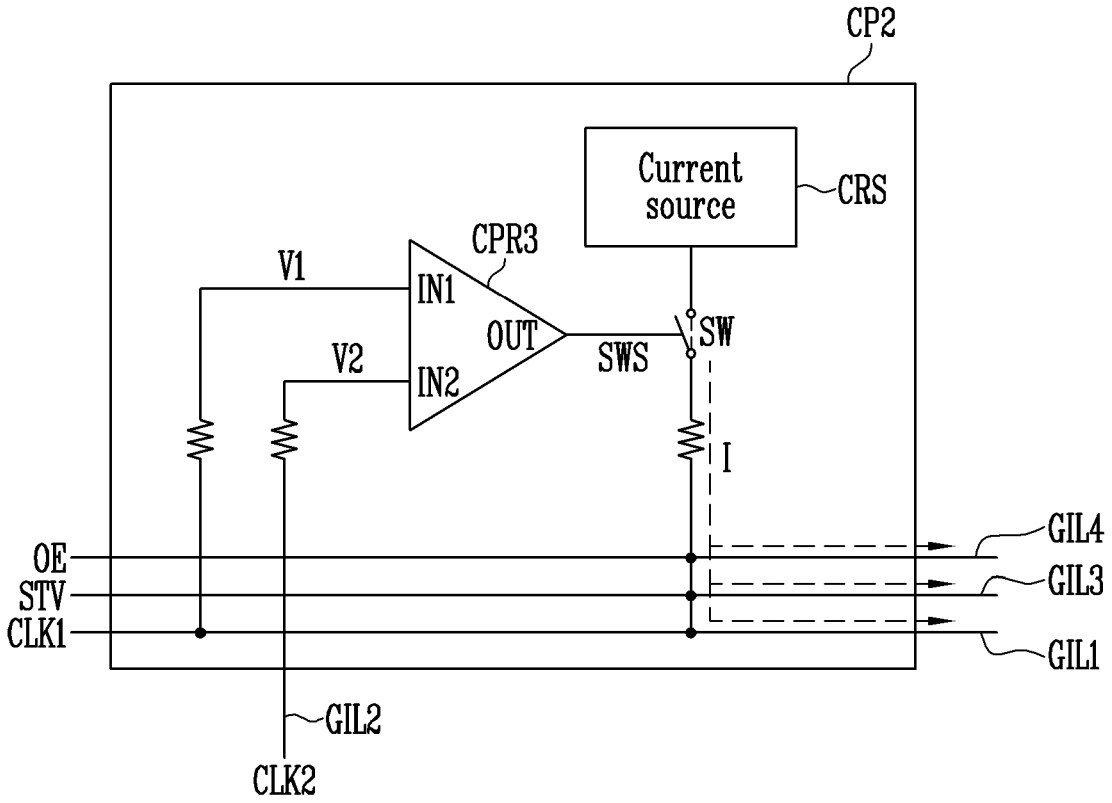
FIG. 9 is a circuit diagram illustrating a second compensator according to some embodiments of the present disclosure.
Figure 10:
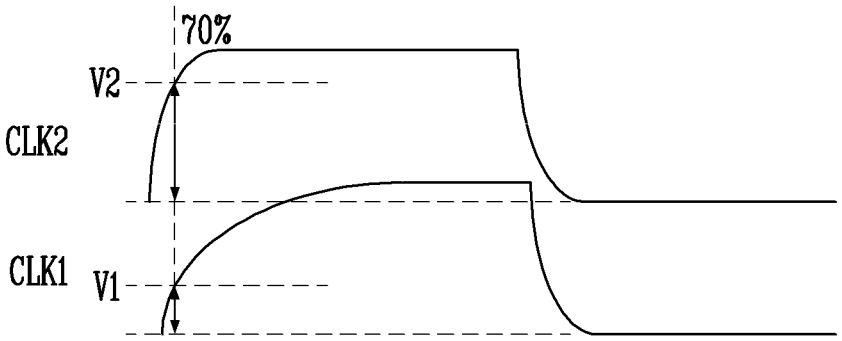
FIG. 10 is a waveform diagram illustrating a first clock signal and a second clock signal input to the second compensator of FIG. 9.

FIG. 8 is a plan view illustrating the gate input lines and the feedback power line FBL of a display device DD according to some embodiments of the present disclosure. For example, FIG. 8 illustrates one area of the display device DD corresponding to the first area AR1 of FIGS. 4A and 4B, and illustrates embodiments that are different from the embodiments described with respect to FIG. 5 with regard to the configuration and operation of gate integrated circuits GIC. FIG. 9 is a circuit diagram illustrating a second compensator CP2 according to some embodiments of the present disclosure. For example, FIG. 9 illustrates an example of a second compensator CP2 provided in each of the gate integrated circuits GIC of FIG. 8. FIG. 10 is a waveform diagram illustrating a first clock signal CLK1 and a second clock signal CLK2 input to the second compensator CP2 of FIG. 9. When the embodiments of FIGS. 8 to 10 are described, components that are similar to or the same as those in the embodiments of FIGS. 5 to 7 are assigned the same reference numerals, and a detailed description thereof will be omitted.

Referring to FIGS. 8 to 10, at least one gate input signal line GIL, including a first gate input signal line GIL1, may be formed to sequentially pass through first to N-th gate circuit boards GFPC1 to GFPCN, and may be connected to first to N-th gate integrated circuits GIC1 to GICN through the first to N-th gate circuit boards GFPC1 to GFPCN. For example, the first gate input signal line GIL1, a third gate input signal line GIL3, and a fourth gate input signal line GIL4 may be formed to pass through the first to N-th gate circuit boards GFPC1 to GFCPN, and may be connected to the first to N-th gate integrated circuits GIC1 to GICN.

According to some embodiments, the first gate input signal line GIL1, the third gate input signal line GIL3, and the fourth gate input signal line GIL4 may be connected between a controller CON and the first to N-th gate integrated circuits GIC1 to GICN, and may extend to sequentially pass through a second circuit board PCB2, a cable CONN, a first circuit board PCB1, any one data circuit board DFPC, and the first to N-th gate circuit boards GFPC1 to GFPCN (N being a natural number equal to or greater than 2), similar to at least one gate input power line VLI illustrated in FIGS. 4A and 4B. Also, the first gate input signal line GIL1, the third gate input signal line GIL3, and the fourth gate input signal line GIL4 may pass through the non-display area NA of a display panel DPN between the first to N-th gate circuit boards GFPC1 to GFPCN and/or in the vicinity thereof.

At least one gate input signal line GIL, including a second gate input signal line GIL2, may be formed in the display panel DPN. For example, the second gate input signal line GIL2 may be formed in the non-display area NA between the display area DA and the first to N-th gate circuit boards GFPC1 to GFPCN so as to be close to the first to N-th gate circuit boards GFPC1 to GFPCN, and may extend along a direction in which the first to N-th gate circuit boards GFPC1 to GFPCN are sequentially arranged (e.g., a longitudinal direction).

The second gate input signal line GIL2 may be connected to the first to N-th gate integrated circuits GIC1 to GICN. For example, the second gate input signal line GIL2 may be connected to the respective gate integrated circuits GIC through the respective gate circuit boards GFPC. Also, the second gate input signal line GIL2 may be connected to the controller CON through any one data circuit board DFPC, the first circuit board PCB1, the cable CONN, and the second circuit board PCB2.

At least one gate integrated circuit GIC may include a second compensator CP2. For example, the gate integrated circuits GIC may have structures that are substantially the same as or similar to each other, and each of the gate integrated circuits GIC may include the second compensator CP2.

Meanwhile, the second compensator CP2 is provided inside the gate integrated circuit GIC according to some embodiments of the present disclosure, but embodiments according to the present disclosure are not limited thereto. For example, the second compensator CP2 may be configured to be separate from the gate integrated circuit GIC and located in the vicinity thereof.

The second compensator CP2 may include input terminals connected to any one gate input signal line GIL, among gate input signal lines formed to pass through the first to N-th gate circuit boards GFPC1 to GFPCN, and connected to any one gate input signal line GIL formed in the display panel DPN. Also, the second compensator CP2 may be connected to at least one gate input signal line GIL formed to pass through the first to N-th gate circuit boards GFPC1 to GFPCN, thereby selectively supplying a current I to the at least one gate input signal line GIL. For example, the second compensator CP2 may be connected to at least one gate input signal line GIL in the vicinity of the output terminal of each gate integrated circuit GIC, thereby selectively supplying a current I to the at least one gate input signal line GIL.

According to some embodiments, the second compensator CP2 may include a third comparator CPR3 and a switch SW connected to the output terminal OUT of the third comparator CPR3. Also, the second compensator CP2 may further include a current source CRS connected to the switch SW.

The third comparator CPR3 may include a first input terminal IN1 connected to the first gate input signal line GIL1, a second input terminal IN2 connected to the second gate input signal line GIL2, and the output terminal OUT connected to the switch SW. The third comparator CPR3 may output a switching signal SWS to the output terminal OUT in response to the voltage difference between the first and second gate control signals input from the first and second input terminals IN1 and IN2.

The first gate input signal line GIL1 may be a line for delivering the first gate control signal output from the controller CON, and the second gate input signal line GIL2 may be a line for delivering the second gate control signal output from the controller CON. The first gate control signal and the second gate control signal may have waveforms that are substantially the same as or similar to each other, and may be output from the controller CON so as to be synchronized with each other. However, the first gate input signal line GIL1 formed to pass through the first to N-th gate circuit boards GFPC1 to GFPCN may have large resistance, compared to the second gate input signal line GIL2 formed in the display panel DPN, and thus the first gate control signal may have a waveform that lags behind that of the second gate control signal.

For example, the first gate control signal may be a first clock signal CLK1 output from the controller CON, and the second gate control signal may be a second clock signal CLK2 output from the controller CON so as to be synchronized with the first clock signal CLK1. However, the first clock signal CLK1 may have a waveform that lags behind that of the second clock signal CLK2 due to the signal delay caused by passing through the first gate input signal line GIL1.

In this case, the third comparator CPR3 may output a switching signal SWS to the output terminal OUT in response to the voltage difference between the first and second clock signals CLK1 and CLK2. For example, the third comparator CPR3 may output a logic-high switching signal SWS to the output terminal OUT in response to the voltage difference between the first and second clock signals CLK1 and CLK2 being equal to or greater than a second set value.

According to some embodiments, the third comparator CPR3 may output the switching signal SWS in response to the voltage difference between the first and second gate control signals at the rising time of the second gate control signal. For example, the third comparator CPR3 may determine that the second gate control signal is transitioned to a high level in response to that the voltage level of the second gate control signal rising and reaching 70% of the maximum voltage level, and may output the switching signal SWS in response to the voltage difference between the first and second gate control signals at the corresponding time.

For example, in response to the first clock signal CLK1 being input to the first input terminal IN1 of the third comparator CPR3 and in response to the second clock signal CLK2 being input to the second input terminal IN2 thereof, the third comparator CPR3 may determine that the second clock signal CLK2 is transitioned to a high level in case that the voltage level of the second clock signal CLK2 rises and reaches 70% of the maximum voltage level, and may output the switching signal SWS in response to the voltage difference between the first and second clock signals CLK1 and CLK2 at the corresponding time. In response to the second clock signal CLK2 being determined to be transitioned to a high level, the first clock signal CLK1 of a first voltage V1 and the second clock signal CLK2 of a second voltage V2 are input to the third comparator CPR3, and in response to the voltage difference between the first voltage V1 and the second voltage V2 being equal to or greater than a second set value (a predetermined second setting voltage), the third comparator CPR3 may output a logic-high switching signal SWS.

The switch SW may be connected to the current source CRS and the first gate input signal line GIL1. According to some embodiments, the switch SW may be further connected between the current source CRS and the third and/or fourth gate input signal line(s) GIL3 and/or GIL4.

The switch SW may be selectively turned on by the switching signal SWS. For example, the switch SW may be turned on in response to a logic-high switching signal SWS.

In response to the switch SW being turned on, the first gate input signal line GIL1 may be connected to the current source CRS, and a current I may be supplied from the current source CRS to the first gate input signal line GIL1. Accordingly, the delay of the first gate control signal (e.g., the first clock signal CLK1) may be compensated for. For example, the slew of the first gate control signal may be improved (e.g., boosted).

In response to the switch SW also being connected between the current source CRS and the third and/or fourth gate input signal line(s) GIL3 and/or GIL4, a current I may also be supplied from the current source CRS to the third and/or fourth gate input signal line(s) GIL3 and/or GIL4 in response to the switch SW being turned on. Accordingly, the delay of the third gate control signal (e.g., a gate start pulse STV) and/or the fourth gate control signal (e.g., a gate output enable signal OE) may also be compensated for. For example, slew of the third and/or fourth gate control signal(s) may be improved.

The current source CRS may supply a current I for compensating for the delay of at least the first gate control signal. According to some embodiments, the current source CRS may be formed using the operating voltage VCC input to the gate integrated circuits GIC.

Figure 11:
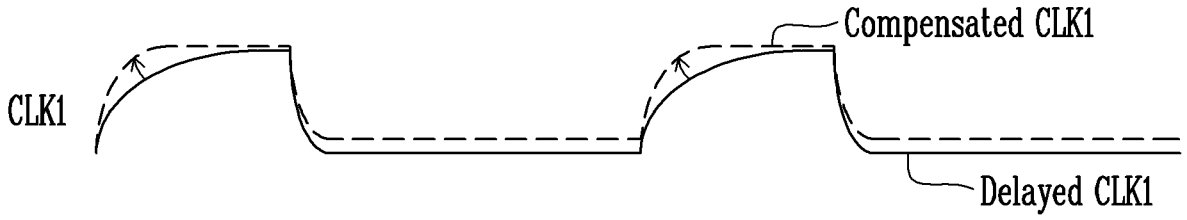
FIG. 11 is a waveform diagram illustrating a first clock signal, the delay of which is compensated for by the second compensator of FIG. 9.
Figure 12:
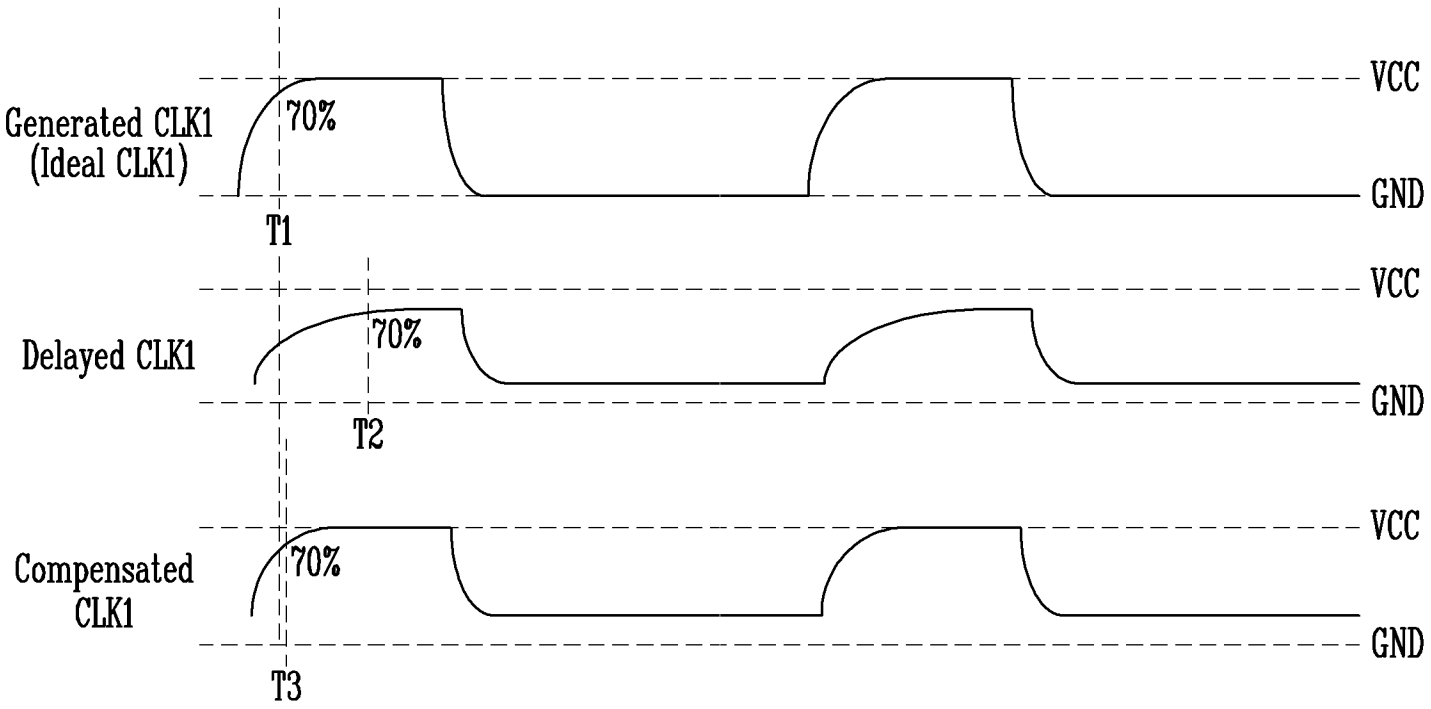

FIG. 11 is a waveform diagram illustrating a first clock signal CLK, the delay of which is compensated for by the second compensator CP2 of FIG. 9. FIG. 12 is a waveform diagram illustrating a first clock signal CLK1 generated in the power supply PS, the first clock signal CLK1 delayed in the first gate input signal line GIL1, and the first clock signal CLK1, the delay of which is compensated for.

First, referring to FIGS. 1 to 11, the voltage drop of the first clock signal CLK1 caused by passing through the first gate input signal line GIL1 that passes through the bonding parts of the first to N-th gate circuit boards GFPC1 to GFPCN may be compensated for in such a way that the voltage drop of the operating voltage VCC of the gate integrated circuits GIC, which is used to generate the first clock signal CLK1, is compensated for. Also, the delay of the first clock signal CLK1 caused or occurred by passing through the first gate input signal line GIL1 may be compensated for by the current I supplied from the second compensator CP2. Accordingly, the first clock signal CLK1 having a voltage level and a waveform through which the gate integrated circuits GIC are capable of being stably driven may be input to the gate integrated circuits GIC.

According to some embodiments, the first, third, and fourth gate input signal lines GIL1, GIL3 and GIL4 passing through the bonding parts of the first to N-th gate circuit boards GFPC1 to GFPCN may have similar resistance, and the third and fourth gate control signals supplied to the gate integrated circuits GIC through the third and fourth gate input signal lines GIL3 and GIL4 may be delayed by the degree similar to the delay of the first gate control signal.

The voltage drop of the third and/or fourth gate control signal(s) (e.g., a gate start pulse SW and/or a gate output enable signal OE) caused or occurred by passing through the third and/or fourth gate input signal line(s) GIL3 and/or GIL4 may be compensated for in such a way that the operating voltage VCC of the gate integrated circuits GIC, which is used to generate the third and/or fourth gate control signal(s), is compensated for. Also, the delay of the third and/or fourth gate control signal(s) caused or occurred by passing through the third and/or fourth gate input signal line(s) GIL3 and/or GIL4 may be compensated for by the current I supplied from the second compensator CP2. Accordingly, the third and/or fourth gate control signal(s) having a voltage level and a waveform through which the gate integrated circuits GIC are capable of being stably driven may be input to the gate integrated circuits GIC.

Referring to FIGS. 1 to 12, in response to the voltage drop and delay of the first clock signal CLK1, which is delayed when it is input to each of the gate integrated circuits GIC (e.g., the N-th gate integrated circuit GICN) through the first gate input signal line GIL1 that passes the bonding parts of the first to N-th gate circuit boards GFPC1 to GFPCN, not being compensated for, the first clock signal CLK1 having a waveform that is different from that of the first clock signal CLK1 output from the power supply PS (e.g., the ideal first clock signal CLK1) may be input to the gate integrated circuit GIC as coming closer to the N-th gate integrated circuit GICN. For example, the voltage drop and the delay of the first clock signal CLK1 may become worse when passing through the first gate input signal line GIL1. Accordingly, the pixels PXL driven by different gate integrated circuits GIC are supplied with gate signals having different waveforms and/or levels, whereby the display panel DPN may have uneven image quality. Also, the operation characteristics of the gate integrated circuits GIC may be degraded by the voltage drop and delay of the first clock signal CLK1.

On the other hand, the first clock signal CLK1, the voltage drop and/or delay of which are (is) compensated for using the first compensator CP1 and/or the second compensator CP2 according to embodiments of the present disclosure, may have a waveform substantially similar to that of the first clock signal CLK1 output from the power supply PS. For example, the first clock signal CLK1 that is compensated for using the first compensator CP1 and the second compensator CP2 may have a voltage level and a waveform that are substantially similar to those of the first clock signal CLK1 output from the power supply PS. For example, the first clock signal CLK1, the voltage drop and/or delay of which are (is) compensated for using the first compensator CP1 and/or the second compensator CP2, is transitioned to a high level at a rising time T3, that is, shortly after the rising time T1 of the first clock signal CLK1 output from the power supply PS, thereby having a voltage level similar to that of the first clock signal CLK1 output from the power supply PS. On the other hand, the first clock signal CLK1 that is delayed in the process of being input to each of the gate integrated circuits GIC is transitioned to a high level at a rising time T2, that is, a long time after the rising time T1 of the first clock signal CLK1 output from the power supply PS, thereby having a voltage level that is more different from that of the first clock signal CLK1 output from the power supply PS.

That is, according to some embodiments of the present disclosure, the delay of the first clock signal CLK1 may be effectively compensated for. Also, in response to the delay of the first clock signal CLK1 being compensated for, the delay of at least one gate control signal other than that (e.g., a gate start pulse SW and/or a gate output enable signal OE) may also be simultaneously compensated for. Accordingly, the gate integrated circuits GIC may be stably driven, and the image quality of the display panel DPN may be improved.

Figure 13:
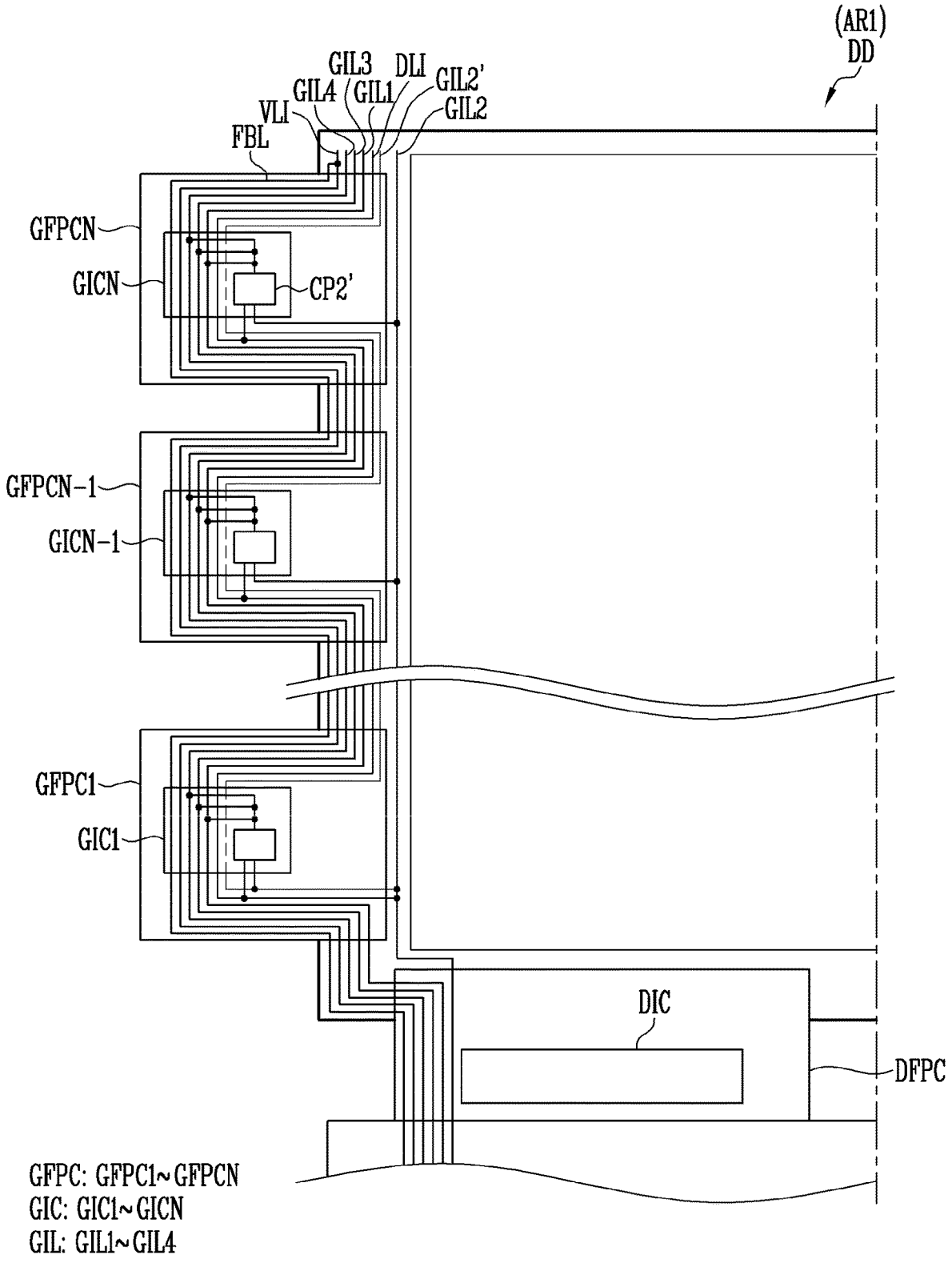
FIG. 13 is a plan view illustrating gate input lines and a feedback power line of a display device according to some embodiments of the present disclosure.
Figure 14:
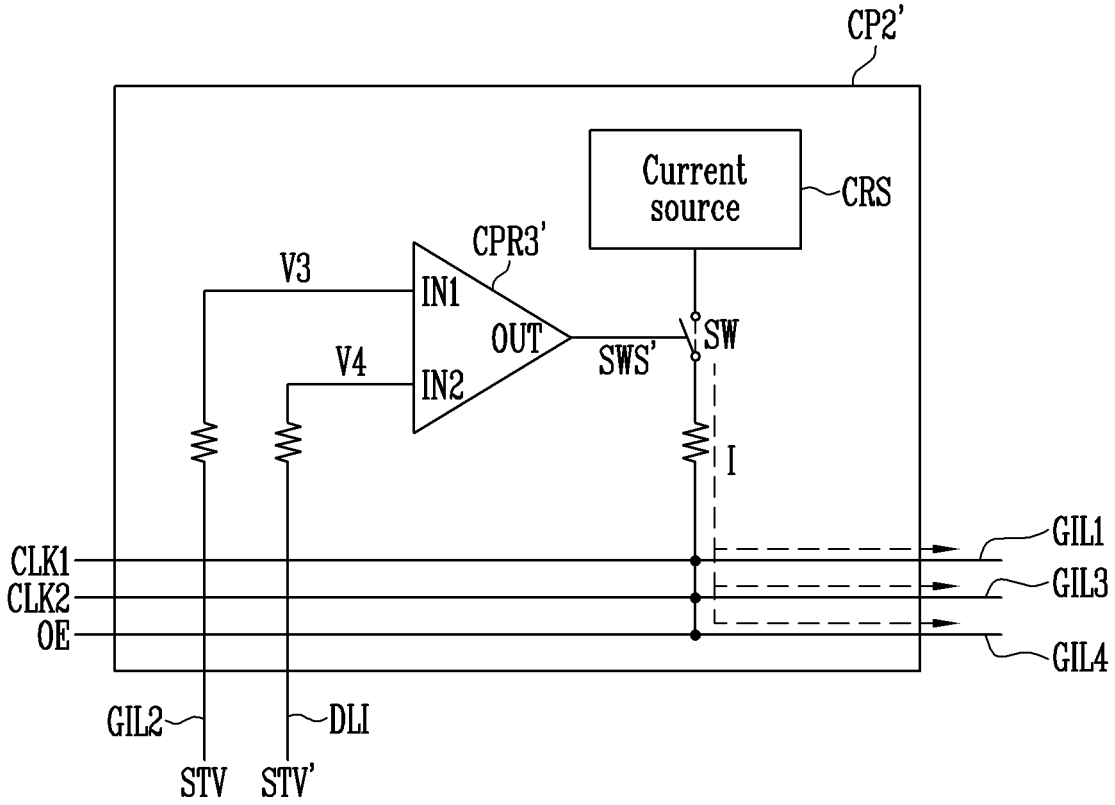
FIG. 14 is a circuit diagram illustrating a second compensator according to some embodiments of the present disclosure.
Figure 15:
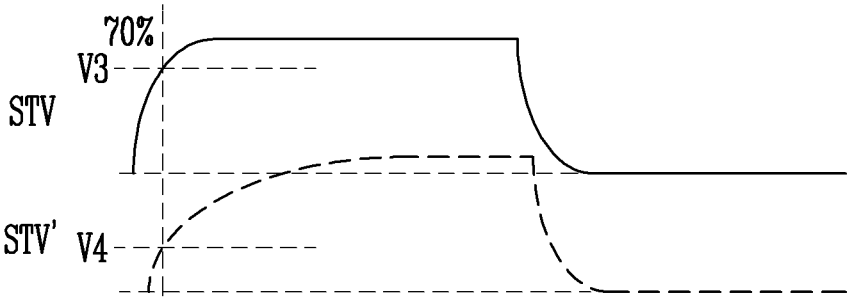
FIG. 15 is a waveform diagram illustrating a gate start pulse input to the second compensator of FIG. 14 and the delay signal of the gate start pulse.

FIG. 13 is a plan view illustrating the gate input lines and the feedback power line FBL of a display device DD according to some embodiments of the present disclosure. For example, FIG. 13 illustrates one area of the display device DD corresponding to the first area AR1 of FIGS. 4A and 4B, and illustrates an alteration of the embodiments described with respect to FIG. 8. FIG. 14 is a circuit diagram illustrating a second compensator CP2' according to some embodiments of the present disclosure. For example, FIG. 14 illustrates an example of the second compensator CP2' provided in each of the gate integrated circuits GIC of FIG. 13. FIG. 15 is a waveform diagram illustrating a gate start pulse STV input to the second compensator CP2' of FIG. 14 and a delayed signal STV' thereof. When the embodiments of FIGS. 13 to 15 are described, components similar to or the same as those in the above-described embodiments are assigned the same reference numerals, and some detailed description thereof may be omitted.

Referring to FIGS. 13 to 15, the display device DD may include a dummy line DLI connected to a second gate input signal line GIL2 and formed to pass through first to N-th gate circuit boards GFPC1 to GFPCN. According to some embodiments, the dummy line DLI is connected to the second gate input signal line GIL2 in the vicinity of the first gate circuit board GFPC1, whereby a second gate control signal may be delivered to the dummy line DLI.

At least one of first to N-th gate integrated circuits GIC1 to GICN may include a second compensator CP2'. For example, each of the first to N-th gate integrated circuits GIC1 to GICN may include the second compensator CP2'.

The second compensator CP2' may detect the delays of the first, third and/or fourth gate control signals, which are caused or occurred in first, third and/or fourth gate input signal lines GIL1, GIL3, and/or GIL4, by referring to the second gate control signal supplied via the dummy line DLI (e.g., the second gate control signal that is more delayed by passing through the dummy line DLI and is referred to as a "delayed signal"), and may compensate for the delays of the first, third, and/or fourth gate control signals.

For example, the second compensator CP2' may selectively supply a current to the first, third, and/or fourth gate input signal lines GIL1, GIL3 and/or GIL4 in response to the voltage difference between the second gate control signal input to the first input terminal IN1 thereof through the second gate input signal line GIL2 and the second gate control signal input to the second input terminal IN2 thereof via the dummy line DLI (e.g., the second gate control signal that is more delayed by passing through the dummy line DLI). For example, the second compensator CP2' may supply a current I to the first, third, and fourth gate input signal lines GIL1, GIL3 and GIL4 in case that the voltage difference between the second gate control signal input to the first input terminal IN1 and the second gate control signal that is more delayed and input to the second input terminal IN2 is equal to or greater than a third set value.

The third set value may be a setting voltage equal to the first set value and/or the second set value, or may be a setting voltage different therefrom. The first, second and third set values may be set to voltages through which the voltage drops and/or delays of the first, third and/or fourth gate control signals can be effectively compensated for depending on the types, waveforms, voltage levels and/or the degrees of delays of the first, third, and/or fourth gate control signals.

The second compensator CP2' may include a current source CRS for selectively supplying a current I to the first, third, and fourth gate input signal lines GIL1, GIL3, and GIL4, a third comparator CPR3' connected to the second gate input signal line GIL2 and the dummy line DLI, and a switch SW that is turned on by a switching signal SWS' output from the third comparator CPR3' and connected between the current source CRS and the first, third, and fourth gate input signal lines GIL1, GIL3, and GIL4.

The third comparator CPR3' may include a first input terminal IN1 connected to the second gate input signal line GIL2, a second input terminal IN2 connected to the dummy line DLI, and an output terminal OUT connected to the switch SW. The third comparator CPR3' may output a logic-high switching signal SWS' in response to the voltage difference between the second gate control signal input to the first input terminal IN1 through the second gate input signal line GIL2 and the second gate control signal input to the second input terminal IN2 via the dummy line DLI being equal to or greater than the third set value.

According to some embodiments, the second gate control signal may be a gate start pulse STV output from the controller CON. In this case, the third comparator CPR3' may output the switching signal SWS' in response to the voltage difference between the gate start pulses STV and STV' input to the first and second input terminals IN1 and IN2 at the rising time of the gate start pulse STV input to the first input terminal IN1 (e.g., in response to the voltage level thereof reaching 70% of the maximum value thereof).

For example, in response to the gate start pulse STV of a third voltage V3 being input to the first input terminal IN1 of the third comparator CPR3' and in response to the delayed gate start pulse STV' of a fourth voltage V4 being input to the second input terminal IN2 of the third comparator CPR3', the third comparator CPR3' may output a logic-high switching signal SWS' in response to the voltage difference between the third voltage V3 and the fourth voltage V4 being equal to or greater than the third set value.

In response to the switch SW being turned on by the logic-high switching signal SWS', the first, third and fourth gate input signal lines GIL1, GIL3 and GIL4 may be connected to the current source CRS, whereby a current I may be supplied to the first, third and fourth gate input signal lines GIL1, GIL3 and GIL4. Accordingly, the delays of the first, third and fourth gate control signals may be compensated for.

In response to the second gate control signal being a gate start pulse STV, the display device DD may further include at least one sub signal line GIL2' for delivering the gate start pulse SW to the first gate integrated circuit GIC1 and delivering the output signal (e.g., a carry signal) of a previous stage or a previous gate integrated circuit GIC to the next stage or the next gate integrated circuit GIC. The sub signal line GIL2' may be connected to the second gate input signal line GIL2 in the vicinity of the first gate integrated circuit GIC1. Accordingly, the gate start pulse SW input to the second gate input signal line GIL2 may be delivered to the first gate integrated circuit GIC1. Also, the sub signal line GIL2' is connected between two stages that are sequentially driven inside each gate integrated circuit GIC, thereby delivering the output signal of the previous stage to the next stage. Similarly, the sub signal line GIL2' is connected between two adjacent gate integrated circuits GIC, thereby delivering the output signal of the previous gate integrated circuit GIC to the next gate integrated circuit GIC. The sub signal line GIL2' may extend to pass through the first to N-th gate integrated circuits GIC1 to GICN.

According to some embodiments, each gate integrated circuit GIC may include a first shift register SR1 and a second shift register SR2, which are driven in parallel to each other and/or individually and configured to output different signals. In this case, the sub signal line GIL2' may include a plurality of lines respectively corresponding to the first shift register SR1 and the second shift register SR2.

Meanwhile, FIGS. 13 to 15 illustrate embodiments in which the switch SW is connected only to the first, third and fourth gate input signal lines GIL1, GIL3 and GIL4, but embodiments according to the present disclosure are not limited thereto. For example, the switch SW may also be connected to the sub signal line GIL2'. In this case, the signal delay caused in the sub signal line GIL2' may be compensated for.

According to a display device in accordance with embodiments of the present disclosure, a plurality of gate input lines, including a first gate input power line and a first gate input signal line, are formed to pass through gate circuit boards, whereby the size of the non-display area of a display panel may be reduced or minimized. Also, the voltage drop of first gate input power may be compensated for by a first feedback voltage for a first gate input voltage that is input to gate integrated circuits through the first gate input power line. Accordingly, the voltage drops of the first gate input power and gate control signals generated by the first gate input power may be compensated for.

Additionally, according to the display device in accordance with embodiments of the present disclosure, a signal delay caused or occurred in the first gate input signal line and the like may be compensated for based on the difference between the voltage of a first gate control signal, which is transferred through the first gate input signal line (or a dummy line) that is formed to pass through the gate circuit boards, (or the voltage of a second gate control signal delayed by passing through the dummy line) and the voltage of a second gate control signal transferred through a second gate input signal line formed in the display panel.

Accordingly, voltage drops and/or signal delays caused or occurred in the gate input lines are compensated for, whereby the operation of a gate driver (e.g., a gate driver formed of a plurality of gate integrated circuits) may be stabilized. Also, the output characteristics of the gate integrated circuits are made uniform, whereby the image quality of the display device may be improved.

Effects according to the embodiments are not limited by the above-mentioned effects, and various effects are included in the present specification.

While the technical idea of the present disclosure is specifically described according to the above-described embodiments, it should be noted that the above-described embodiments are only for illustrative purposes rather than limiting the technical idea of the present disclosure. Also, it should be understood by those skilled in the art to which the present disclosure pertains that various alterations may be made herein without departing from the technical idea of the present disclosure.

The scope of embodiments according to the present disclosure is not limited by detailed descriptions of the present specification, and should be defined by the accompanying claims and their equivalents. Furthermore, all changes or modifications of the present disclosure derived from the meanings and scope of the claims, and equivalents thereof should be construed as being included in the scope of the present disclosure.

What is claimed is:

1. A display device, comprising:

a display panel including pixels in a display area;

first to N-th gate integrated circuits embedded in gate circuit boards connected to the display panel and configured to output gate signals to the pixels, where N is a natural number equal to or greater than 2;

a first gate input power line and a first gate input signal line passing through the gate circuit boards and connected to the gate integrated circuits;

a first feedback power line connected to the first gate input power line;

a power supply configured to output a first gate input voltage to the first gate input power line;

a first compensator connected to the first feedback power line and configured to output a first compensation signal in response to a first feedback voltage transferred from the first feedback power line; and a controller configured to output a first gate control signal to the first gate input signal line and to output a power control signal to the power supply in response to the first compensation signal, wherein the power supply adjusts the first gate input voltage in response to the power control signal.

2. The display device according to claim 1, wherein the first feedback power line is connected to the first gate input power line at the N-th gate integrated circuit and passes through the gate circuit boards.

3. The display device according to claim 2, wherein the N-th gate integrated circuit is farthest from the power supply from among the first to N-th gate integrated circuits.

4. The display device according to claim 2, wherein:

the gate circuit boards include first to N-th gate circuit boards in which the first to N-th gate integrated circuits are respectively embedded, the first gate integrated circuit is connected to the power supply via the first gate circuit board, and the N-th gate integrated circuit is connected to the power supply via the first to N-th gate circuit boards.

5. The display device according to claim 1, wherein:

the power supply outputs a first reference voltage to the first compensator, and the first compensator is configured to output the first compensation signal at a logic high level to the controller in response to a voltage difference between the first feedback voltage and the first reference voltage being equal to or greater than a first set value.

6. The display device according to claim 5, wherein the controller is configured to output the power control signal for changing the first gate input voltage in response to the first compensation signal at the logic high level.

7. The display device according to claim 6, wherein:

the power supply is configured to output the first gate input voltage to the controller, and the controller is configured to generate the first gate control signal using the first gate input voltage.

8. The display device according to claim 1, wherein the first gate input voltage is an operating voltage of the first to N-th gate integrated circuits.

9. The display device according to claim 8, further comprising:

a second gate input power line through which a second gate input voltage is supplied from the power supply, the second gate input power line passing through the gate circuit boards and connected to the first to N-th gate integrated circuits; and a second feedback power line connected to the second gate input power line, the second feedback power line being passing through the gate circuit boards and connected to the first compensator.

10. The display device according to claim 9, wherein the first compensator includes:

a first comparator configured to output the first compensation signal depending on a voltage difference between the first feedback voltage and a first reference voltage; and a second comparator configured to output a second compensation signal depending on a voltage difference between a second feedback voltage transferred from the second feedback power line and a second reference voltage.

11. The display device according to claim 10, wherein the controller is configured to control the first gate input voltage generated in the power supply in response to the first compensation signal and to control the second gate input voltage generated in the power supply in response to the second compensation signal.

12. The display device according to claim 11, wherein the second gate input voltage is one of a gate-off voltage and a gate-on voltage.

13. The display device according to claim 1, further comprising:

a second gate input signal line formed in the display panel so as to be adjacent to the gate circuit boards and connected to the first to N-th gate integrated circuits.

14. The display device according to claim 13, wherein the controller is configured to output a second gate control signal synchronized with the first gate control signal to the second gate input signal line.

15. The display device according to claim 14, wherein at least one of the first to N-th gate integrated circuits includes a second compensator configured to supply a current to the first gate input signal line in response to a voltage difference between the first gate control signal and the second gate control signal, respectively transferred through the first gate input signal line and the second gate input signal line, being equal to or greater than a second set value.

16. The display device according to claim 15, wherein the second compensator includes:

a current source configured to supply the current;

a third comparator configured to output a switching signal depending on the voltage difference between the first gate control signal and the second gate control signal; and a switch connected between the current source and the first gate input signal line and configured to be selectively turned on in response to the switching signal.

17. The display device according to claim 15, wherein:

the first gate control signal is a first clock signal output from the controller, and the second gate control signal is a second clock signal output from the controller so as to be synchronized with the first clock signal.

18. The display device according to claim 13, further comprising:

a dummy line connected to the second gate input signal line and formed to pass through the gate circuit boards.

19. The display device according to claim 18, wherein at least one of the first to N-th gate integrated circuits includes a second compensator configured to supply a current to the first gate input signal line in response to a voltage difference between a second gate control signal transferred through the second gate input signal line and a second gate control signal transferred through the dummy line being equal to or greater than a third set value.

20. The display device according to claim 19, wherein the second gate control signal is a gate start pulse output from the controller.

* * * * *